US006675616B1

(12) United States Patent
Horton

(10) Patent No.: US 6,675,616 B1
(45) **Date of Patent: *Jan. 13, 2004**

(54) INTERNAL LOCKING DEVICE FOR USE ON MAGAZINE DOORS

(75) Inventor: Craig H. Horton, Ventura, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/244,921

(22) Filed: Sep. 10, 2002

(51) Int. Cl.[7] ..... E05B 35/08

(52) U.S. Cl. ..... 70/337; 70/423; 70/455; 70/209; 70/223; 70/456 R

(58) Field of Search ..... 70/337, 387, 103, 70/104, 107–109, 113, 120, 423, 455, 209, 223, 188, 189, DIG. 63, 456 R, 82, 224, 427

(56) References Cited

U.S. PATENT DOCUMENTS 2,484,547 A * 10/1949 Bishop ..... 70/414
3,137,157 A * 6/1964 Ralton ..... 70/456 R
3,224,052 A * 12/1965 Abraham ..... 24/3.1
3,292,400 A * 12/1966 Merila ..... 70/414
4,073,165 A * 2/1978 Grundstrom et al. ..... 70/37
4,107,967 A * 8/1978 Grabb ..... 70/427
4,113,291 A * 9/1978 Cameron ..... 292/40
4,404,916 A * 9/1983 Ingram ..... 109/67
4,587,817 A * 5/1986 Self ..... 70/427
5,195,342 A * 3/1993 Werner ..... 70/417
6,474,248 B1 * 11/2002 Stark et al. ..... 109/59 R
6,494,070 B1 * 12/2002 Moss et al. ..... 70/423
6,553,796 B2 * 4/2003 Finch ..... 70/208

* cited by examiner

*Primary Examiner*—John B. Walsh
(74) *Attorney, Agent, or Firm*—David S. Kalmbaugh

(57) ABSTRACT

An internal locking device adapted for use with the magazine doors of a weapons storage facility to lock the magazine doors and secure the facility. The internal locking device use a dual key and key guides for key insertion and for reduction of key breakage. The internal locking device includes a pair of locking bolts which when dis-engaged from the output shaft by an operator rotating the keys allows the operator turn handle which turns the output shaft for the device unlocking the magazine doors.

23 Claims, 19 Drawing Sheets

INTERNAL LOCKING DEVICE FOR USE ON MAGAZINE DOORS

BACKGROUND OF THE INVENTION

Field of the Invention

The present invention relates generally to locking mechanisms and devices. More specifically, the present invention relates to a key activated internal locking device for use on weapons storage magazine doors.

Presently, magazine doors for weapons storage facilities/magazines at military installations are secured by high security padlocks which include hasps. High security padlocks are generally placed on the exterior of the magazine doors which subject the padlocks to extreme environmental conditions such as intense heat, bitter cold, rain and snow. These environmental conditions can have an adverse impact on the operational capabilities of the padlocks and their effectiveness in preventing theft of munitions from the weapons storage facilities.

Weapons storage facilities which use high security padlocks are generally not resistant to forced entry. The high security padlock also requires periodic lubrication and maintenance to insure that it operates correctly. Key damage and breakage is problem associated with the use of high security padlocks at weapons storage facilities. Further, there is a need locking device that allows for the integration of an electrical intrusion detection system into the locking device.

One such device used in the past to secure is disclosed in U.S. Pat. No. 4,587,817, entitled "High Security Internal Locking System" issued May 13, 1986 to Henry L. Self. Disclosed in U.S. Pat. No. 4,587,817 is a locking system consisting of two locking mechanisms protected by a drill resistive shutter plate. The shutter plate can be rotated to expose a first lock which when unlocked allows it to be further rotated to uncover the second lock. Upon unlocking the second lock, the drive for the main bolt lock can be actuated.

Accordingly, there is a need for a high security locking device which provides substantial improvement to force entry resistance over high security padlocks and is not vulnerable to the environment and operational problems associated with a harsh environment. In addition, the high security locking device should preferably not require periodic lubrication and maintenance. The high security locking device be adapted for use with an electrical intrusion detection system which senses the presence of a person not authorized to use the locking device.

SUMMARY OF THE INVENTION

The present invention comprises a highly efficient and effective high security internal locking device which is adapted for use with the magazine doors of a weapons storage facility and which is highly resistant to forced entry by individuals not authorized to access the facility. The internal locking device may be configured to require the use of either two keys or one key to open the magazines doors for the weapons storage facility.

To open the magazine doors of the weapons storage facility the operator first turns a handle ninety degrees which rotates a shutter plate connected to the handle. This allows the operator to insert a key into a single lock cylinder when the internal locking device utilizes a single key operated device to open the magazines doors. When the internal locking device utilizes a pair of keys to open the magazine doors for the weapons storage facilities, the operator inserts a pair of keys into a pair of lock cylinders within the internal locking device after the shutter plate is rotated which exposes the lock cylinders.

The internal locking device includes key guides which allow for quick, fluid key insertion of the keys into the lock cylinders. The key guides, in turn, reduce key breakage. The internal locking device also has a push-through key feature which allows the user to remove a broken key from a lock cylinder by pushing the key through the lock cylinder using another key.

A one key operated internal locking device has one locking bolt slidable mounted in its housing, while a two key operated internal locking device has a pair of locking bolts slidably mounted in its housing. The locking bolts engage and lock the output shaft in a fixed rotational position which insures that the magazine doors remain locked. For a one key operated internal locking device the locking bolt is operatively connected to the lock cylinder so that rotation by the operator of the key dis-engages the locking bolt from the output shaft. For a two key operated internal locking device each of the locking bolts is operatively connected to one of the two lock cylinder so that rotation by the operator of the keys disengages the locking bolts from the output shaft.

The operator next pushes the handle forward towards the housing which moves a spring loaded clutch to the output shaft. The clutch engages the output shaft allowing the operator to rotate the output shaft by rotating the handle counterclockwise ninety degrees. Rotating the shaft removes a door locking bolt operatively connected to the shaft from a locking bolt receiver located on one of the two magazine doors allowing the operator to open the magazine doors and gain access to the weapons storage facility.

BRIEF DESCRIPTION OF THE DRAWINGS

FIG. 15 illustrates a single locking bolt arrangement which engages and prevents rotation of the output shaft until the operator dis-engages the locking bolt from the output shaft using a single key;

DETAILED DESCRIPTION OF THE PREFERRED EMBODIMENTS

Figure 1:
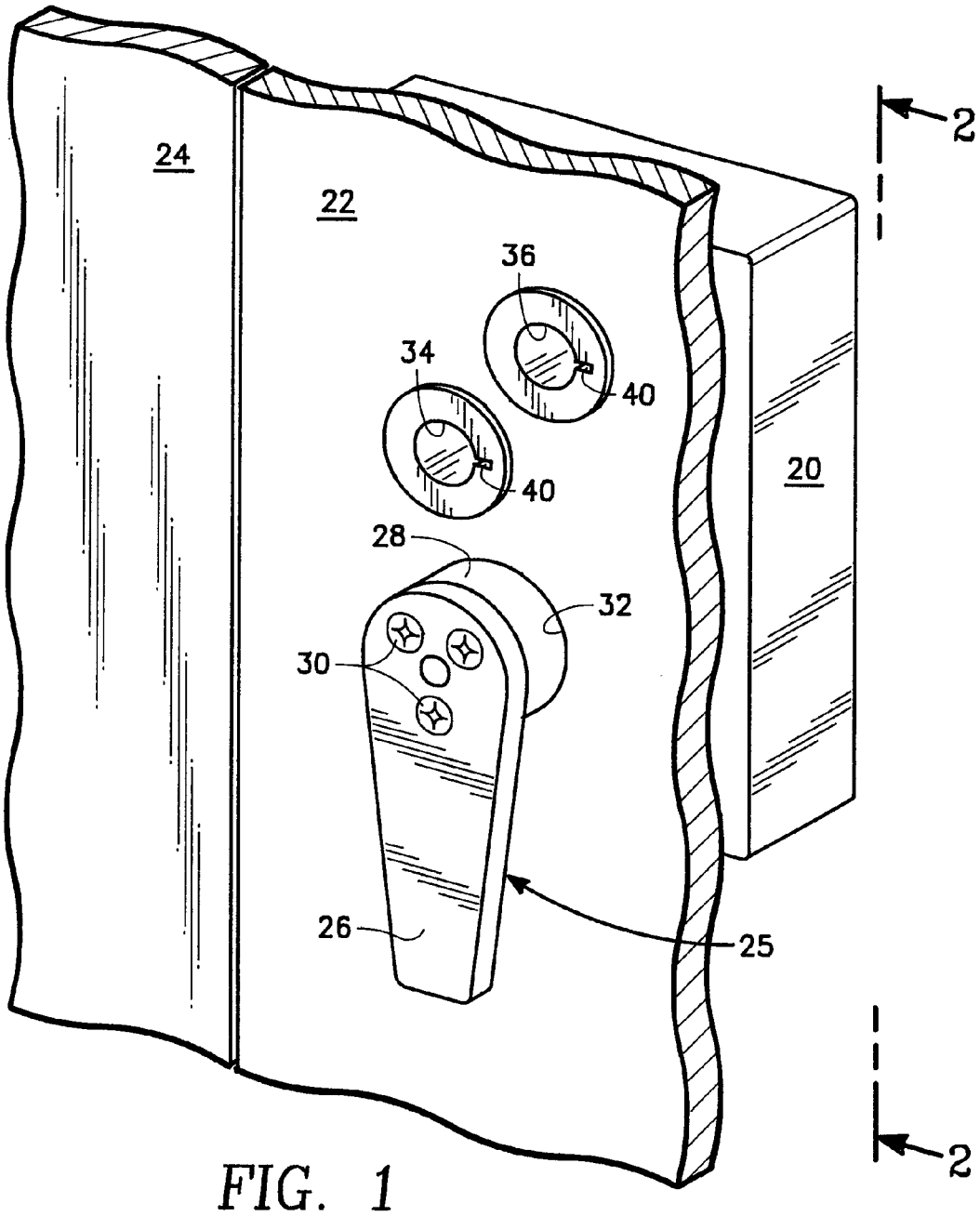
FIG. 1 illustrates a front view of the magazine doors for a weapons storage facility which utilizes the internal locking device comprising the present invention.

Referring first to FIG. 1, an internal locking device 20 is mounted on the inside surface of a magazine door 22. A plurality of welds 23 are used to secure the internal locking device 20 to the inside surface of magazine door 22. The internal locking device 20 is very useful in preventing entry into a high security facility such as weapons storage facility. The internal locking device 22 is specifically designed to improve forced entry resistance delaying entry into a secured facility over five times the forced entry time required when a high security padlock and hasp are used to secure the facility. In addition, the internal locking device 22 is also designed to shelter device 22 from hostile environmental conditions. This, in turn, results in a high security locking system that is very resistant to wind driven sand, dust, rain and ice, corrosive salt spray, extreme heat and cold and freeze-thaw conditions.

As shown in FIG. 1, the secured facility has a second magazine door 24 which is secured to magazine door 22 by the internal locking device 20. Device 20 comprises a lever arm subassembly, designated generally by the reference numeral 25, which has a handle 26 attached to a handle extension 28. Handle 26 is secured to handle extension 28 by a plurality of hex head screws 30. Handle extension 28 passes through an opening 32 in magazine door 22. Opening 32 has a brass bearing or other type of bearing 33 mounted therein which allows for substantially frictionless rotational movement of handle extension 28 within magazine door 22.

Figure 6A:
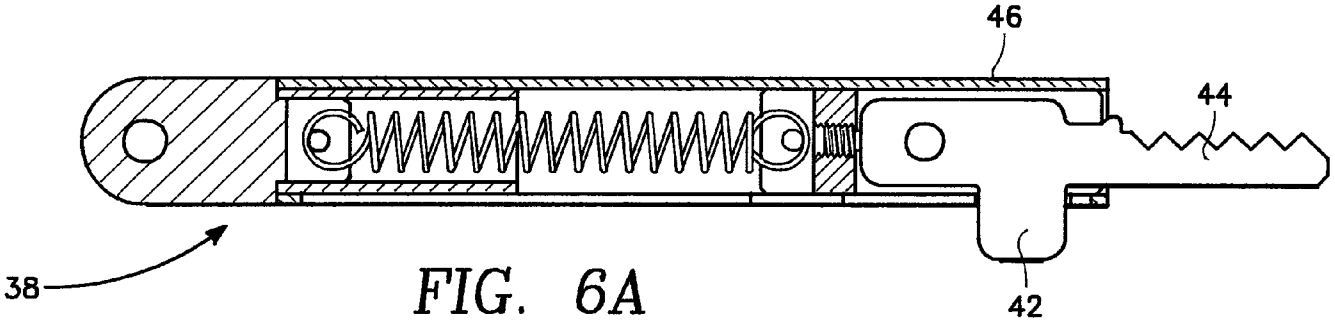
FIGS. 6A–6C depict the key and key housing used to unlock the internal locking device comprising the present invention.
Figure 6B:
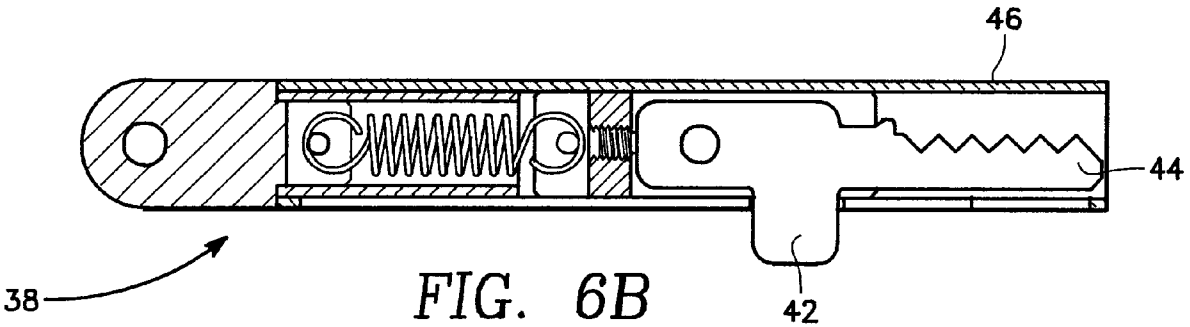
Figure 6C:
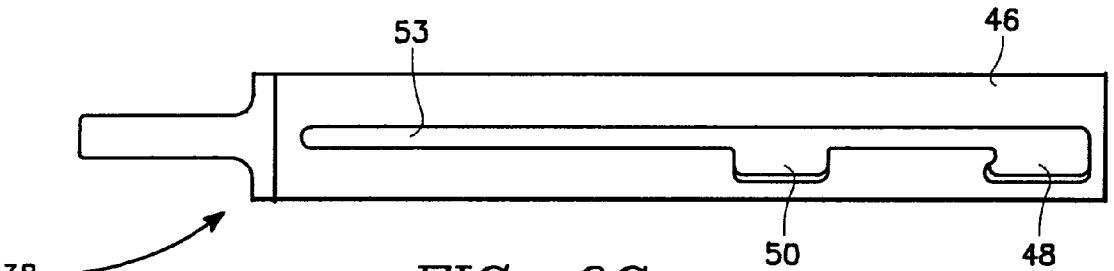
Figure 7:
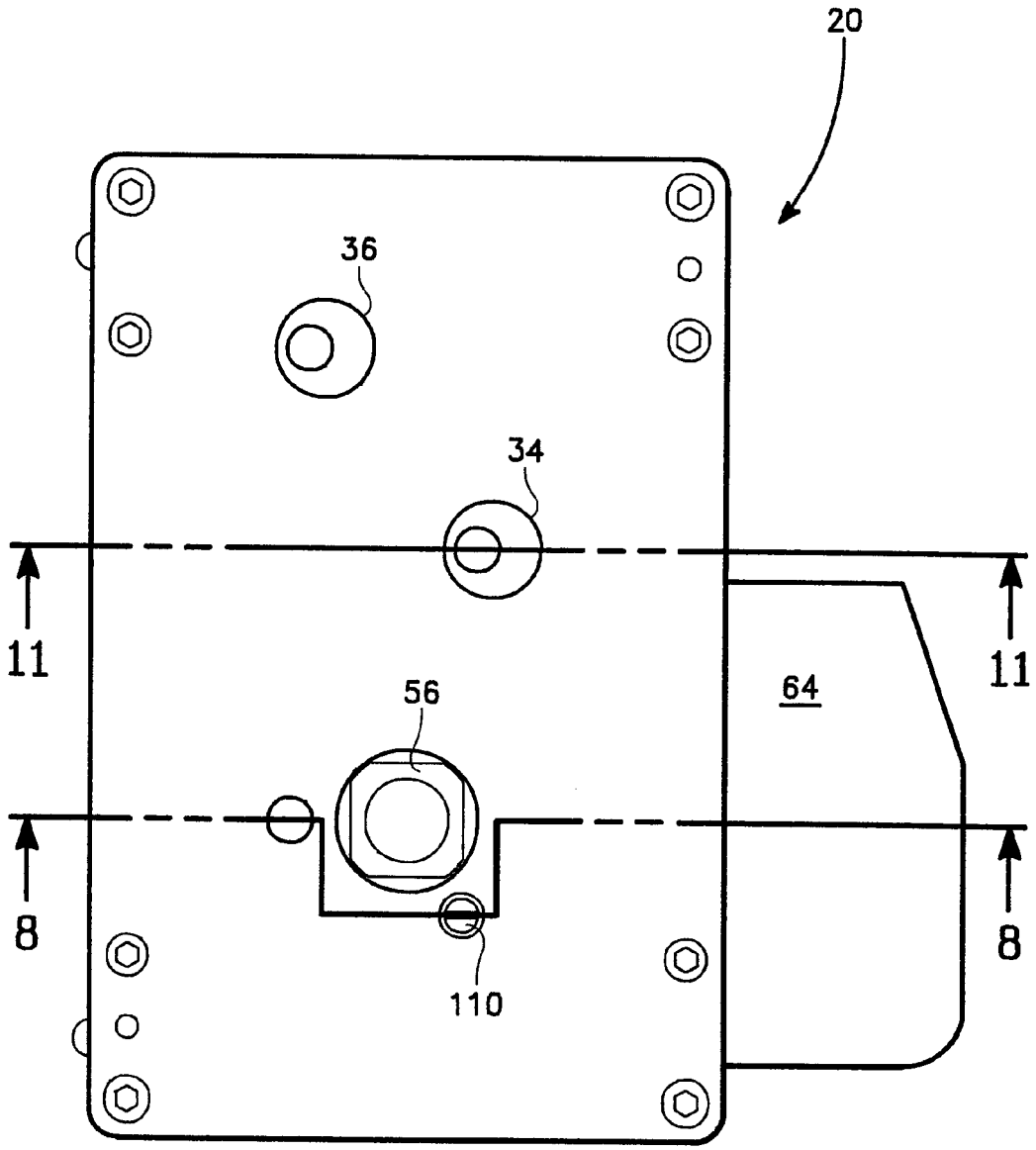
FIG. 7 is a rear view of the internal locking device comprising the present invention.

Referring to FIGS. 1 and 6A–6C, magazine door 22 includes pair of cylindrical shaped openings 34 and 36 which are adapted to receive the high security key assemblies 38 of the type illustrated in FIGS. 6A–6C. Each cylindrical shaped opening 34 and 36 has a guide slot 40 which receives the key guide 42 for key 44. The key guide 42 for each key 44 insures quick, fluid key insertion and substantially reduces the chances of key breakage when the key is inserted into the lock cylinder 92. As shown in FIG. 6A, the key 44 is fully extended from the key housing 46 and locked into a recess 48 within the key housing 46. The key housing 46 is cylindrical shaped and sized to fit within cylindrical shaped openings 34 and 36 within door 22.

This allows the user to insert key 44 into the lock cylinder 92 and then open the weapons storage magazine doors 22 and 24. Since the door 22 has slots in each of its cylindrical shaped opening 34 and 36 to guide the key into the lock cylinder 92, it is almost impossible to break the key. If the key is broken, the key can be removed from the lock cylinder 92 by pushing the broken portion of the key through the lock cylinder 92 using another key.

Figure 11:
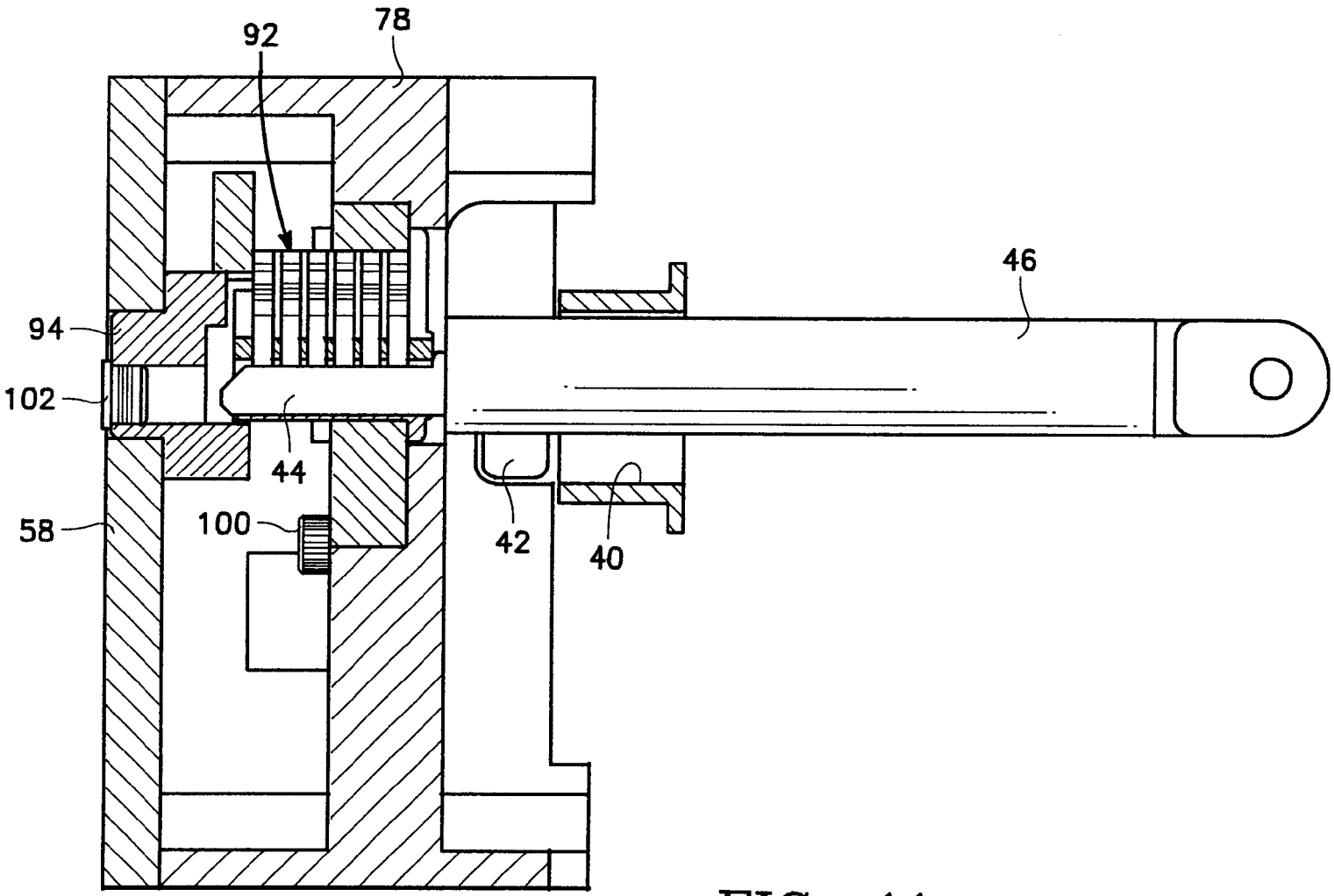
FIG. 11 is a view in partial section which depicts a key lock cylinder mounted in the housing of the present invention.
Figure 12:
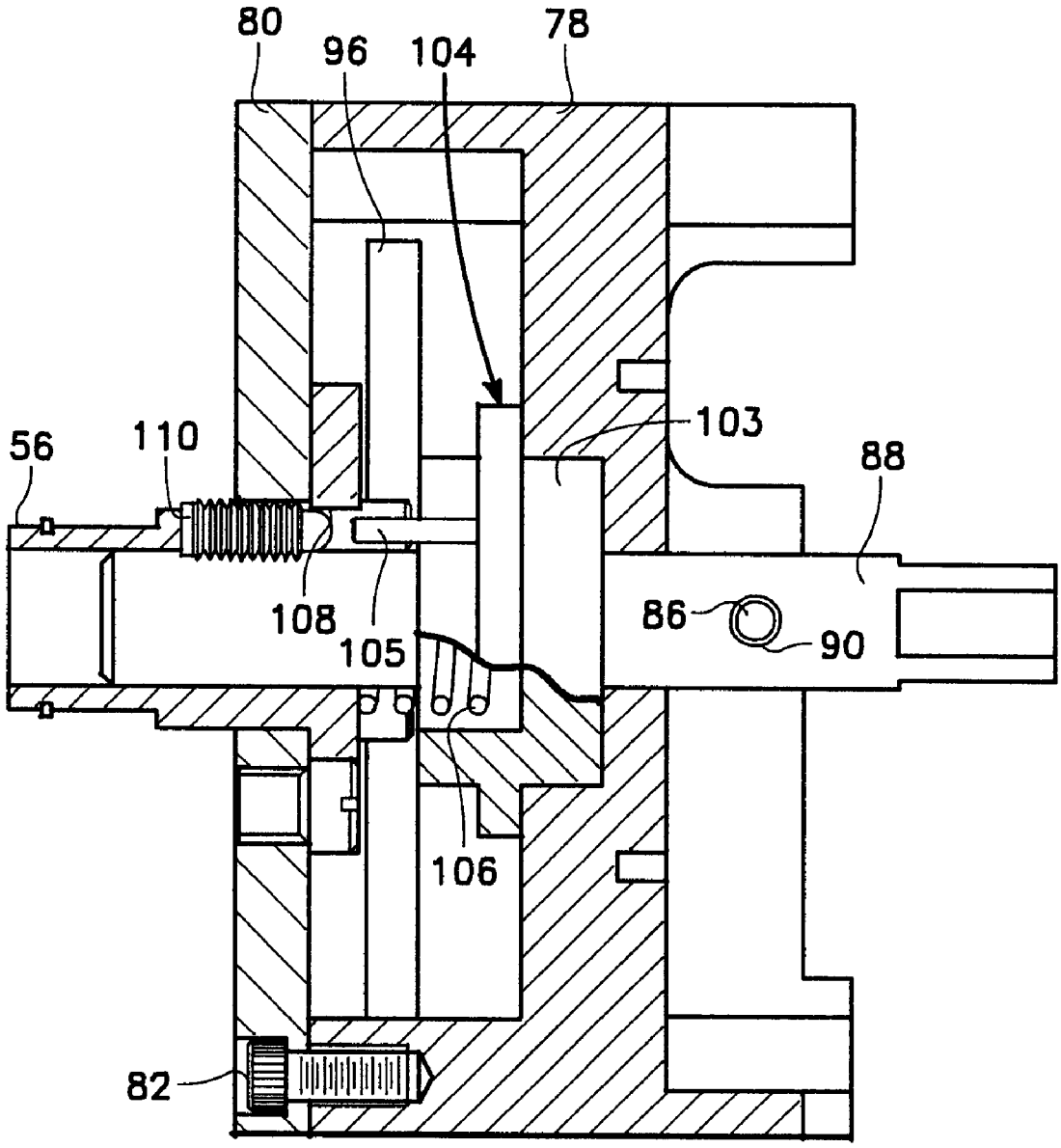
FIGS. 12–15 are views in partial section which depict the housing, clutch, output shaft and lock cylinder for the present invention.

The key illustrated in FIGS. 6A–6C is designed such that the key can not be turned until the key is fully inserted into the key cylinder as shown in FIG. 11. This prevents breakage of the key which was a significant in high security locks utilized in the past.

At this time, it should be noted that the shutter plate 74 provides a limited seal to keep dirt and dust out of the key cylinder for the lock cylinder 92 since the shutter plate makes direct with locking device housing 78.

As shown in FIG. 6B, the key 44 is fully retracted and locked into a recess 52 within the key's housing 46 which prevents damage to key 44 when key 44 is not in use. A slot 53 within housing 46 connects recess 50 to recess 48.

It should be noted that keys are often difficult and subject to breakage when inserted in padlocks with shrouded hasp which are typically used on the magazines doors of weapons storage facilities. The novel approach utilized by device 20 tends to prevent this breakage and allows for easy removal of a key in the event a key breaks within the lock cylinder 92.

Referring to FIGS. 1–5 and 8, 9 and 10, an output shaft 56 extends from the back plate 58 of internal locking device 20. A cam arm 60 is connected to the end of output shaft 56 which extends from internal locking device 20. A locking screw 62 is used to secure cam arm to output shaft 56. Rotation of output shaft 56 rotates cam arm 60 in clockwise direction when a user desires to unlock magazine doors 22 and 24 and a clockwise direction when a user desires to lock magazine doors 22 and 24.

Figure 2:
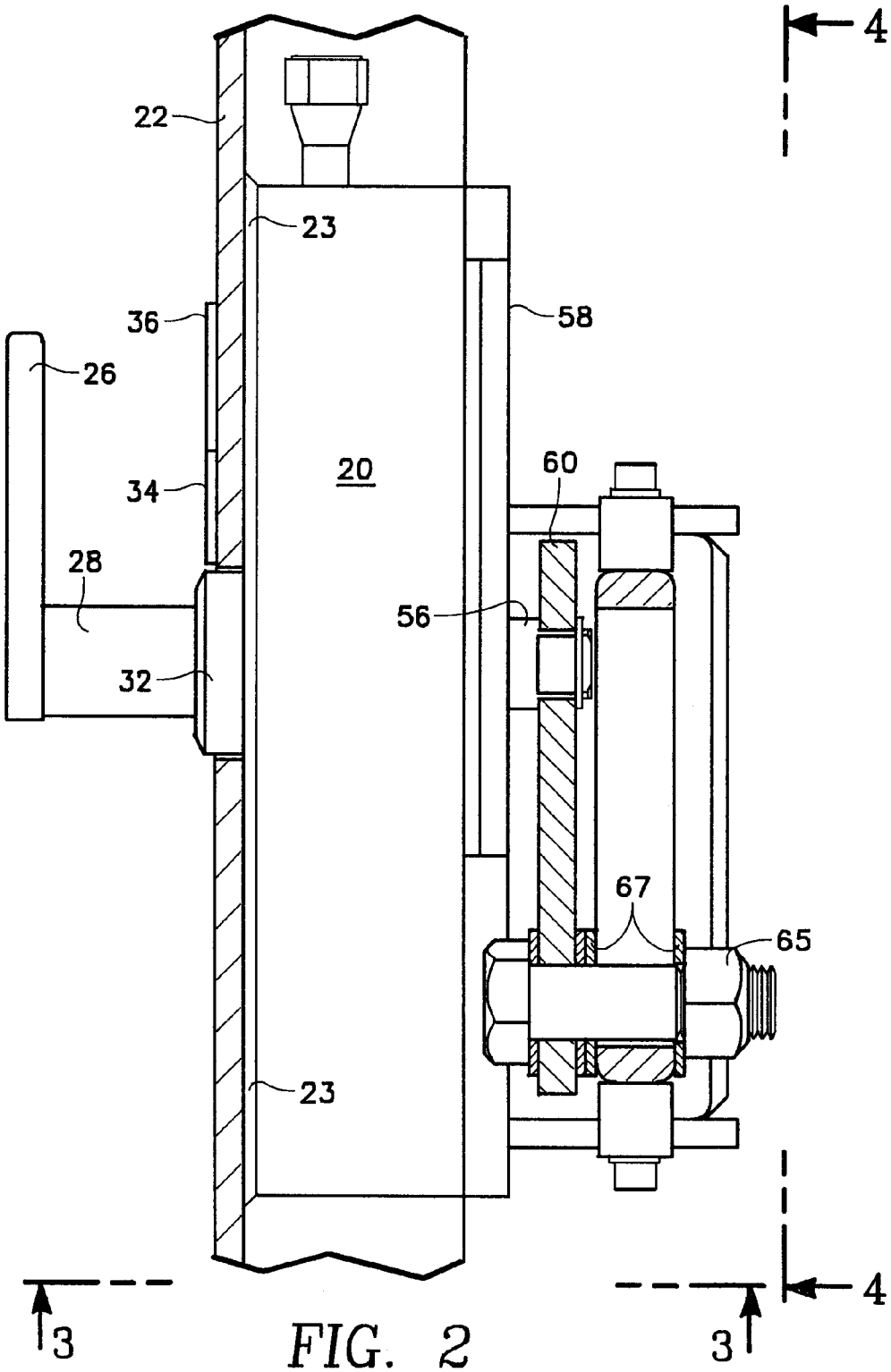
FIG. 2 is a side view, in partial section, which depicts the door locking bolt assembly for the magazine doors of FIG. 1.
Figure 3:
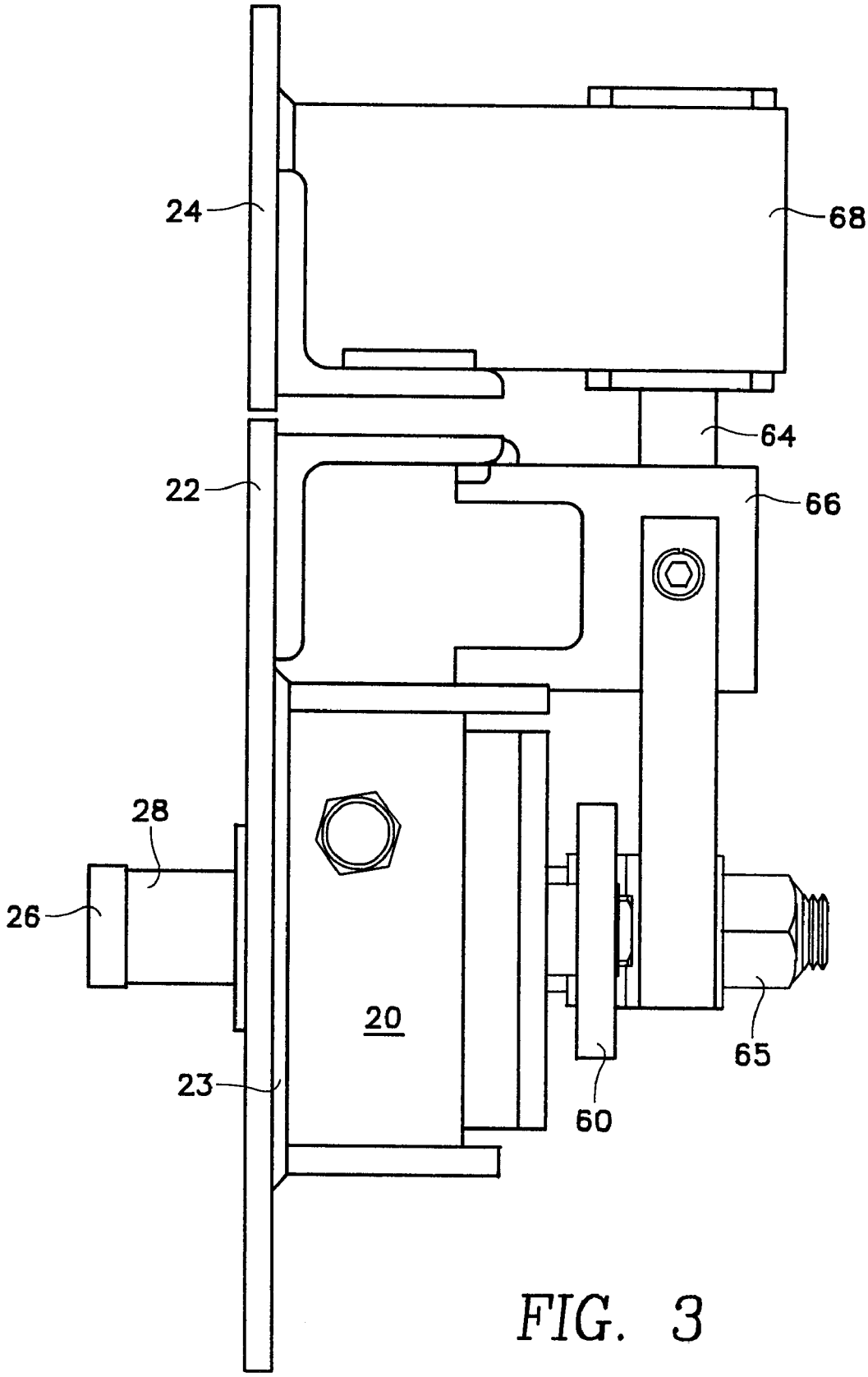
FIG. 3 is a top view of the door locking bolt assembly of FIG. 2.
Figure 4:
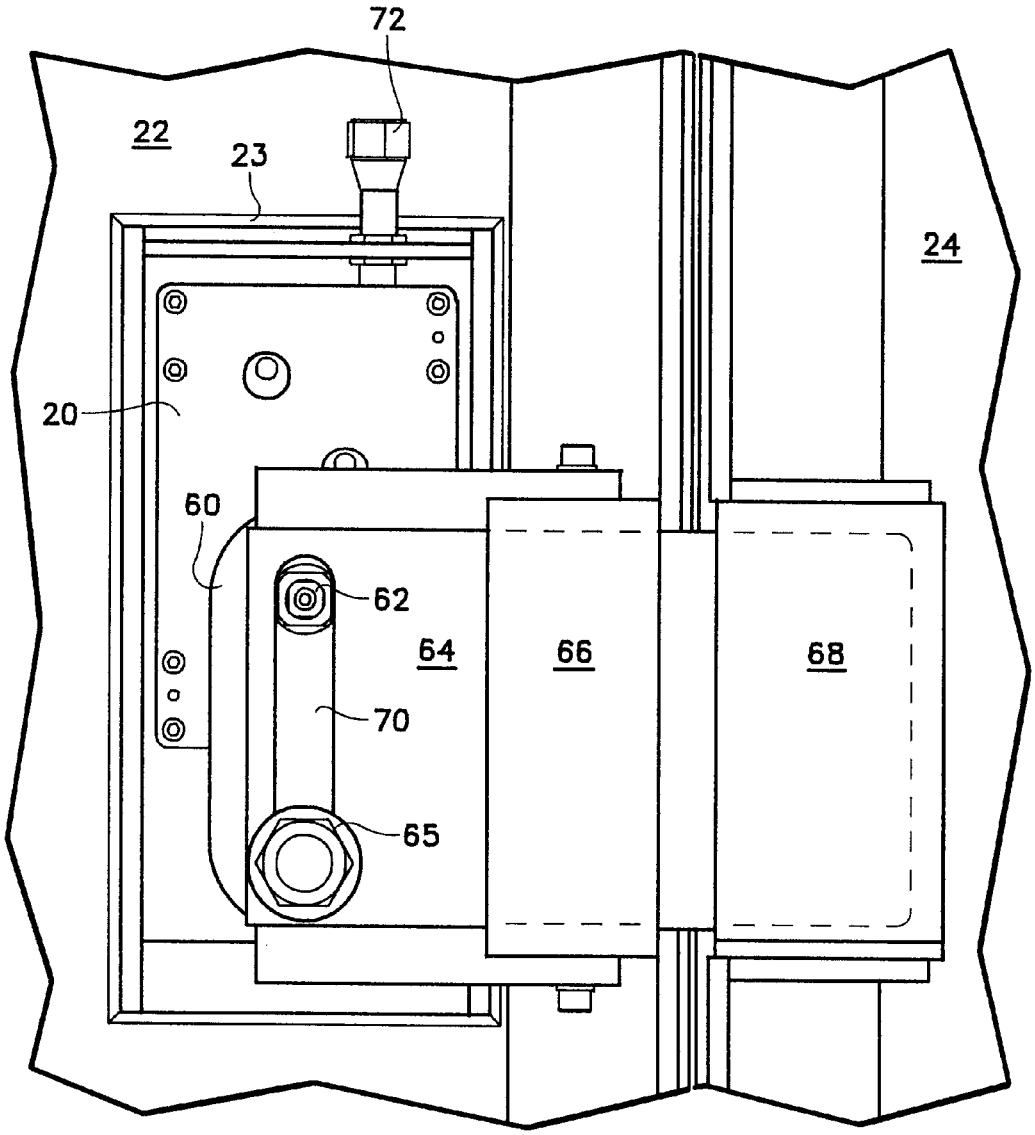
FIG. 4 is a view from inside the weapons storage facility of the door locking bolt assembly of FIG. 2.
Figure 5:
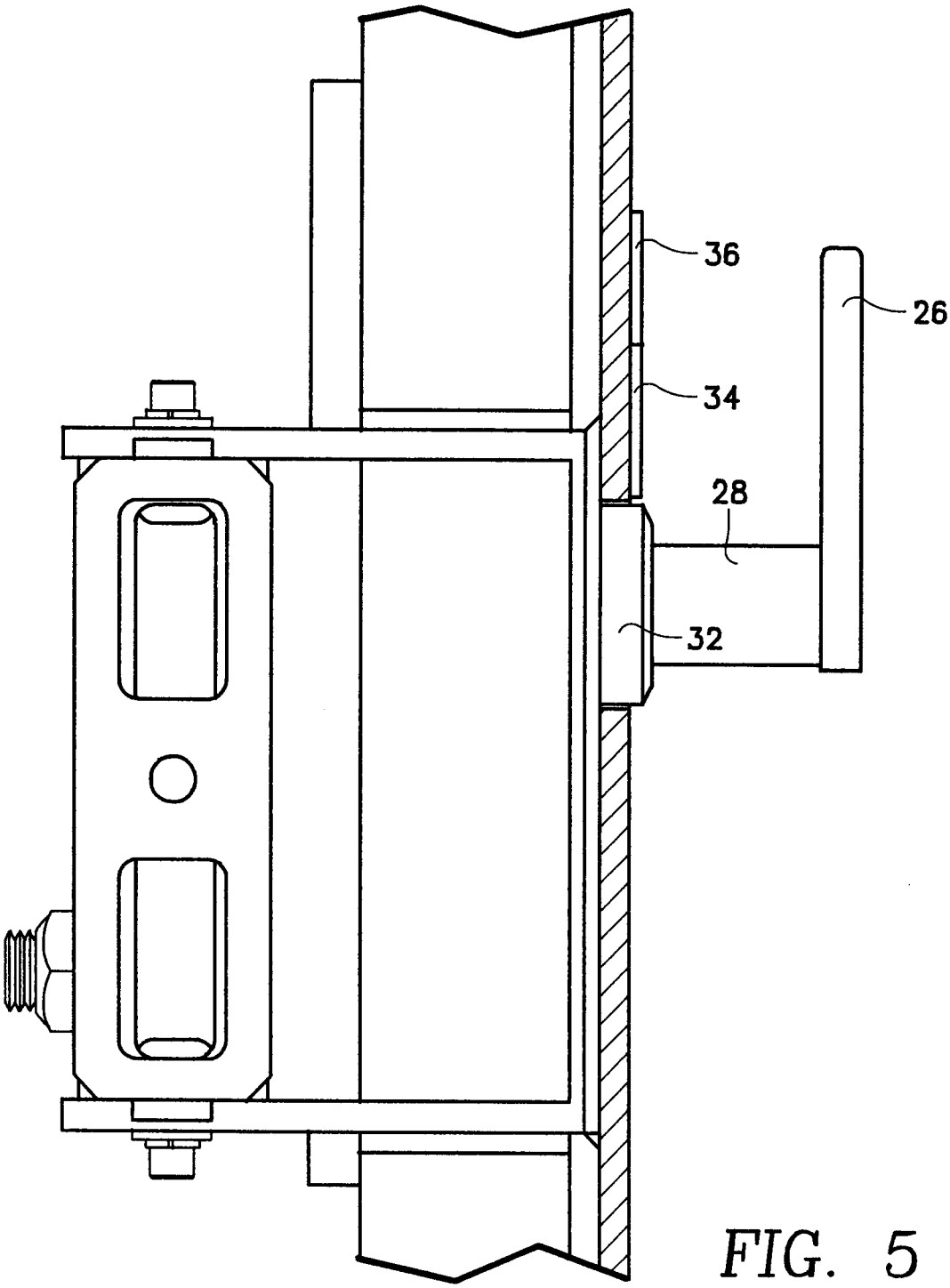
FIG. 5 is an opposite side view which depicts the door locking bolt assembly for the magazine doors of FIG. 1.

A door locking bolt 64 is operatively connected to the cam arm 60 by a nut and bolt assembly 65 which is best depicted in FIGS. 2 and 4. Nut and bolt assembly 65 includes a plurality of washers 67 which allow the nut and bolt assembly 65 to rotate freely within the a vertically positioned slot 70 disposed at one end of cam arm 64 as shown in FIG. 4. When output shaft 56 rotates in a clockwise direction, cam arm 60 also rotates in clockwise direction causing door locking bolt 64 to withdraw from locking bolt receiver 68 which is attached to magazine door 24 by welds (not illustrated). This allows a user to open the magazine doors 22 and 24 and gain access to weapons and the like stored within the weapons storage facility. Alignment of the door locking bolt 64 is maintained by a locking bolt receiver 66 when the magazine doors 22 and 24 are unlocked and open. Locking bolt receiver 64 is attached to magazine door 22 by welds (not illustrated).

When output shaft 56 rotates in a counter-clockwise direction, cam arm 60 also rotates in counter-clockwise direction causing door locking bolt 64 to engage and slide through locking bolt receiver 68 securing and locking magazines doors 22 and 24.

Figure 8:
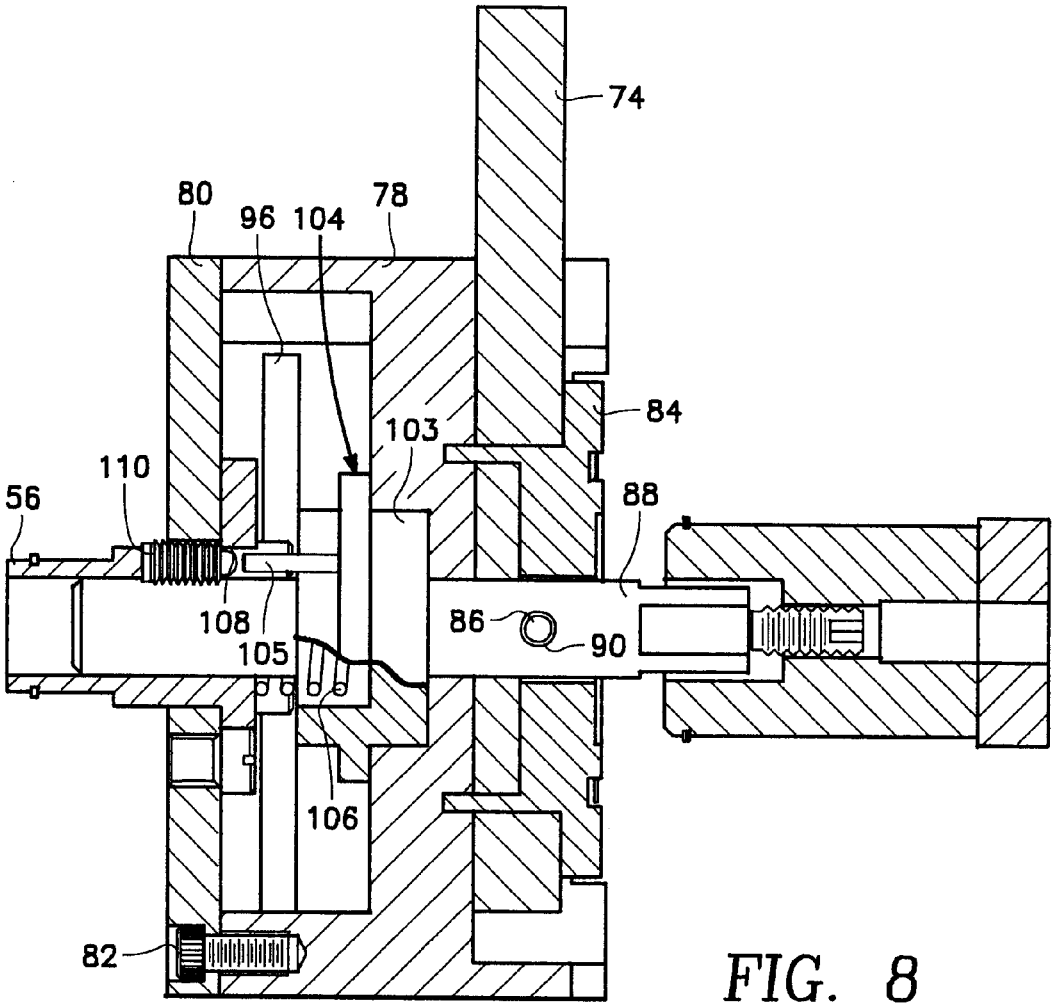
FIG. 8 is a detail schematic, in section, of the internal locking device comprising the present invention.
Figure 9:
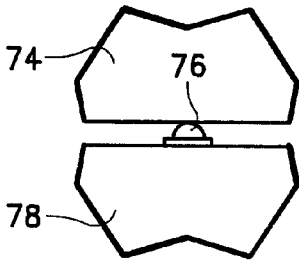
FIG. 9 depicts a shutter plate which engages a normally open alarm activation switch for an alarm system used in conjunction with the present invention.

Positioned on the top of internal locking device 20 is a wire conduit 72 which includes the wire for an electronic monitoring and control system. When the user rotates the handle 26 in the clockwise direction positioning a shutter plate 74 in vertical position as depicted in FIG. 8, the bottom end of the shutter plate 74 engages a normally open alarm activation switch 76 as depicted in FIG. 9. When a security alarm 77 (FIG. 10) is active and an unauthorized user attempts to turn the handle 26 to gain access to the weapons storage facility, the shutter plate 74 engages the alarm activation switch 76 which activates the alarm 77 alerting the appropriate individuals as to the presence of intruder at the weapons storage facility.

Figure 10:
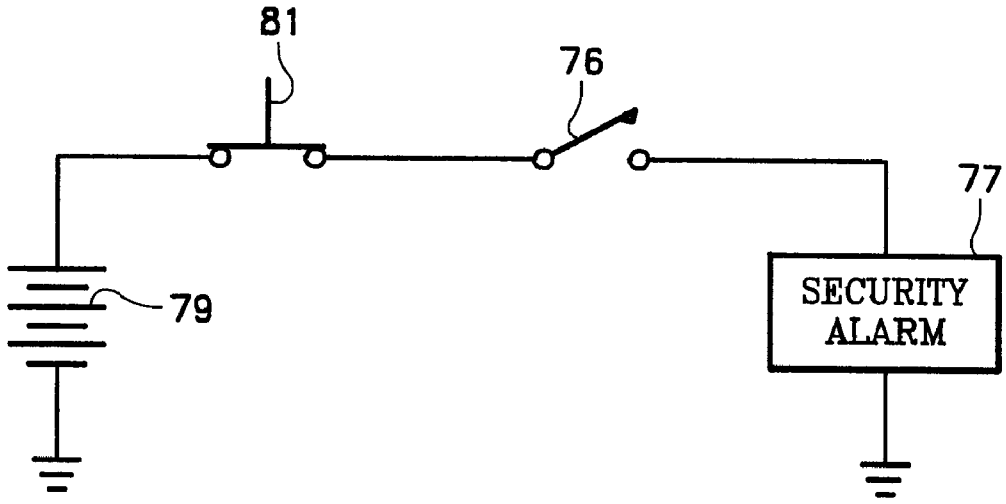
FIG. 10 depicts the electrical for the alarm system used in conjunction with the present invention.

As shown in FIG. 10, a circuit to activate the security alarm may include a battery 79 having its output connected to a push button switch 81. Push button switch 81 is normally closed and may only be opened by an authorized user who needs to gain access to the weapons storage facility. When an individual, not authorized to access the weapons storage facility, attempts to access the facility the alarm is activated by rotating the shutter plate 74 which completes the electrical current flow path for the circuit of FIG. 4.

Referring to FIGS. 1, 8A and 8B, a partial sectional view of the internal locking device 20. The internal locking device 20 includes a internal locking device housing 78. A back plate 80 is secured to housing 78 by means of a plurality of set screws 82. Removal of the back plate 80 allows a user to access the internal components of internal locking device 20.

Shutter plate 74 is attached to a shutter plate hub 84. A pin 86 extending from a cam shaft or lock shaft 88 and secured thereto is recessed within a slot or groove 90 on the backside of shutter plate hub 84. The shutter plate hub 84 and the shutter plate 74 comprise the shutter plate subassembly for internal locking device 20. The groove allows the shutter plate 74 to engage and dis-engage shaft 88. For example, when the handle is pushed inward in the direction indicted by arrow 156 (FIG. 19), the pin 86 is removed from groove 90 which dis-engages the shutter plate 74 from the shaft 88.

Referring to FIGS. 1, 8, 11 and 15, the housing 78 has a lock cylinder 92, which is depicted in FIG. 11. When there is a requirement for two keys to open the magazine doors 22 and 24 (as shown in FIG. 11), the housing 78 would have an additional lock cylinder 92 of the type illustrated in FIG. 11. High security lock cylinders of the type used in the present invention are commercially available from Medeco Security Locks, Inc. of Salem, Va. Such locks, which are virtually pick proof, are shown in U.S. Pat. No. 3,499,302.

The lock cylinder 92 includes a rotatably mounted plug or cylinder. When the key 44 is inserted in the lock cylinder 92, the lower segments of a plurality of pin tumblers are raised by exactly the correct amount to bring their tops flush with the outer surface of the cylinder. As the lower and upper surfaces of the pin tumblers are separated, that is not interconnected, the plug or cylinder is free to rotate when the key housing 46 is rotated by the user.

The lock cylinder 92 is positioned within housing 78 by a cylinder plug 98 which aligns lock cylinder 92 with key 44 and allows the key 44 to be removed from housing through an opening 101 in the back plate 58 of internal locking device housing 78. The cylinder plug 98 is secured to the housing 78 by a plurality of screws 100. Positioned at the rear of opening 101 is a plastic plug 102.

The cylinder plug 98 allows the user to remove the lock cylinder 92 and replace it with a different lock cylinder without removing the internal locking device 20 from the inside surface of a magazine door 22. In the past, security locks have required removal of the entire lock from the magazine door to change the key cylinder.

Figure 13:
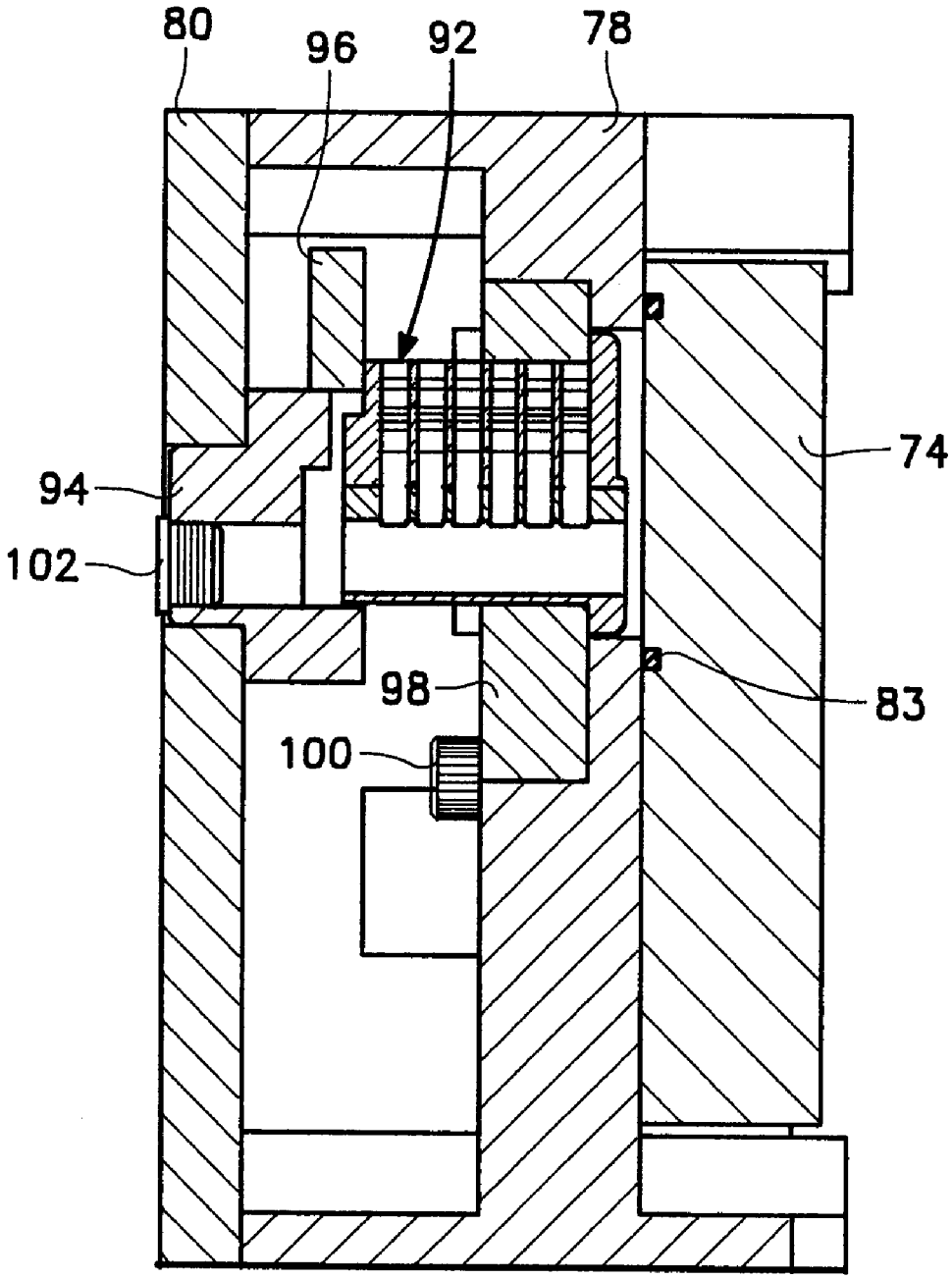
Figure 14:
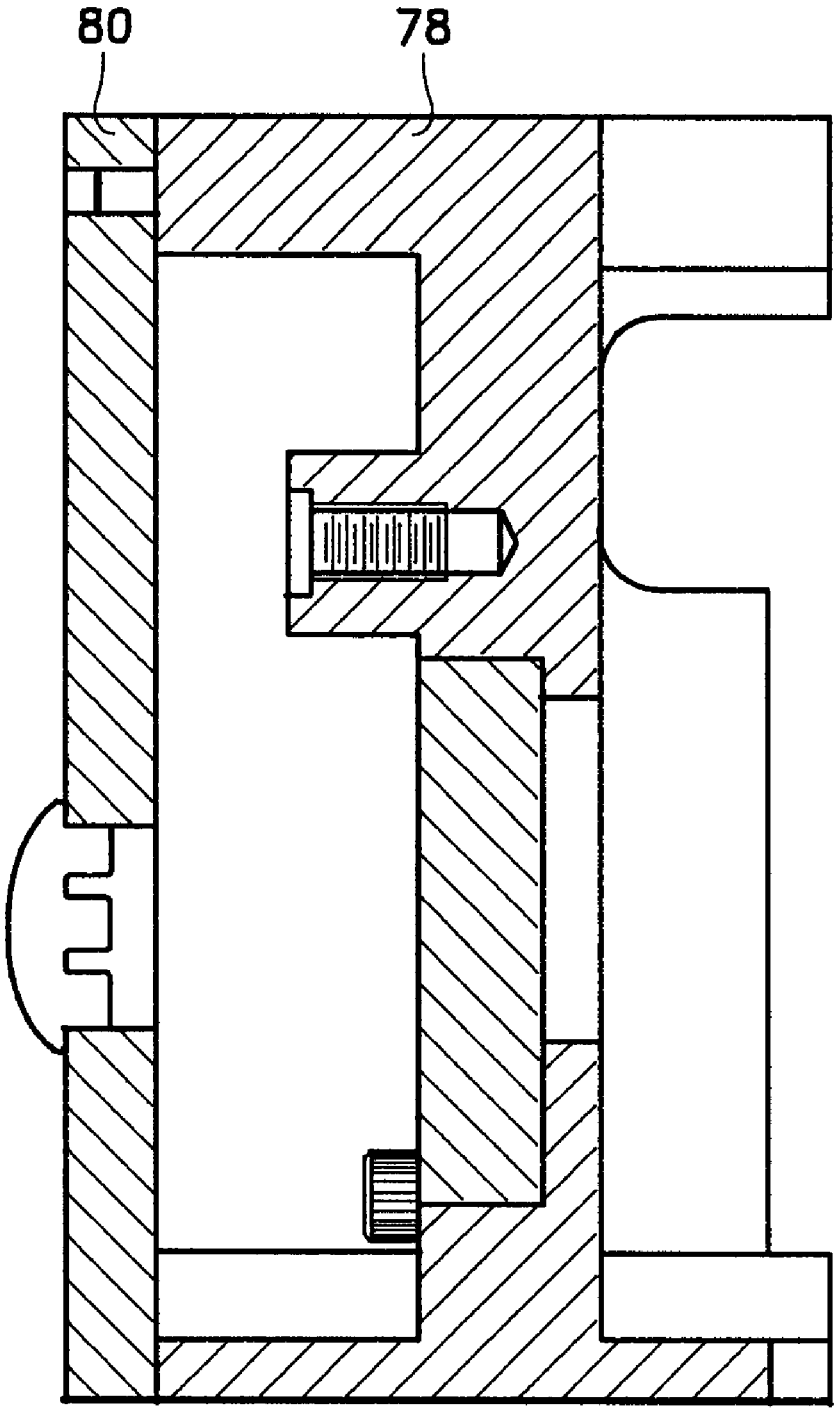

As depicted in FIG. 13, there is a dust seal 83 positioned between the lock body or locking device housing 78 and the shutter plate 74. The dust seal 83 assist in preventing dust from entering lock cylinder 92 which could render the lock cylinder inoperable.

It should be noted that the clearance between cylinder plug 98 and the locking device housing 78 is excessive (in the order of several thousandths of inch). This clearance feature allows the lock cylinder 92 to float within the locking device housing 78 providing means whereby the lock cylinder 92 and cam 94 align with the openings in the back of cover plate 80.

For an internal locking device 20 which requires the use of one key to open magazine doors 22 and 24, the plug or cylinder of lock cylinder 92 is in rotatable engagement with an eccentric cam shaft/lock cylinder cam 94. An eccentric cam shaft 95 is attached to the cylinder for lock cylinder 92. The lock cylinder cam 94 is mounted on shaft 95 such that rotation of the shaft 95 rotates the cam 94.

Figure 15:
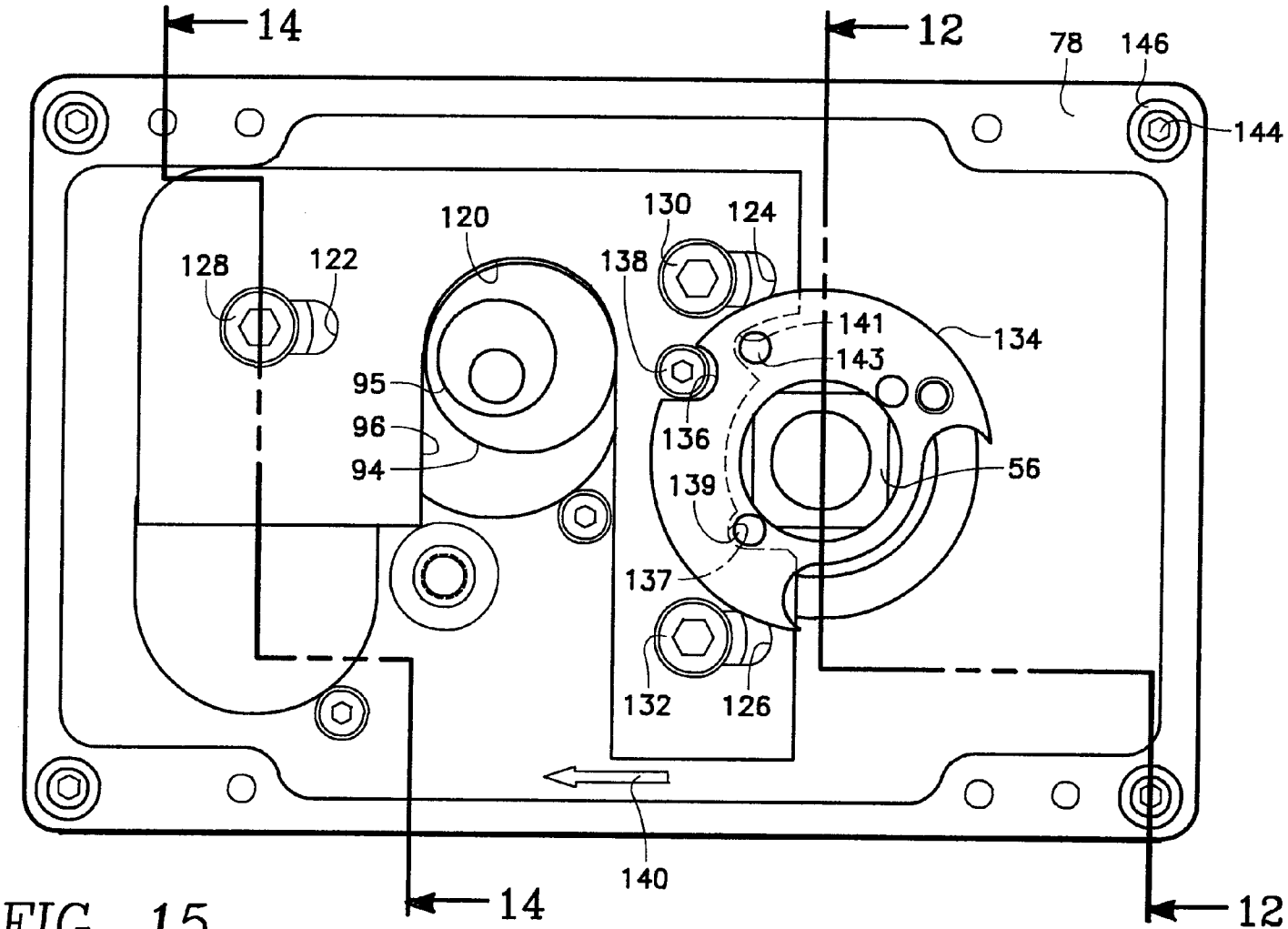

After the user inserts the key 44 into the lock cylinder 92, the user turns the key 44 housing 46 counter-clockwise rotating the key 44 which rotates the lock cylinder cam 94. The lock cylinder cam 94 rotatably engages a locking bolt/locking plate 96 slidably mounted within the internal locking device housing 78. The locking bolt 96 has a U shaped slot 120 in which the lock cylinder cam 94 rotates when the operator turns the key 44. The locking bolt 96 includes a trio of horizontally positioned slots 122, 124 and 126. Affixed to a front portion of internal locking device housing 78 and removable therefrom are a trio of set screw 128, 130 and 132. As depicted in FIG. 15 set screw 128 is positioned within slot 122 and in slidable engagement therewith, set screw 130 is positioned within slot 124 and in slidable engagement therewith and set screw 132 is positioned within slot 126 and slidable engagement therewith.

The output shaft 56 has a generally circular shaped plate 134 affixed thereto. Rotation of the output shaft 56 rotates plate 134. Plate 134 includes a semi-circular indent 136 formed on its outer edge which engages a set screw 138 bolted to locking plate 96. Locking bolt 96 also has semi-circular indents 137 and 141 formed on its outer edge which respectively engage locking pins 139 and 143 affixed to internal locking device housing 78. Set screw 137 and locking pins 139 and 143 prevent rotational movement of output shaft 56 until an operator dis-engages set screw 138 from indent 136 within plate 134, locking pin 139 from indent 137 and locking pin 143 from indent 141 by rotating key 44 counter-clockwise which moves locking bolt 96 in the direction indicated by arrow 140.

When an operator turns the key 44 counter-clockwise, the lock cylinder cam 94 rotates in a clockwise direction which moves the locking plate 96 away from plate 134 in the direction indicated by arrow 140. Movement of the locking plate 96 in the direction indicted by arrow 140 dis-engages set screw 138 from indent 136, locking pin 139 from indent 137 and locking pin 143 from indent 141 which allows for rotational movement of the output shaft 56. To lock the output shaft 56 in a fixed positioned, the cam 94 is rotated in a clockwise direction which causes locking bolt 96 to move to plate 134 which locks plate 134 in a fixed position with respect to locking bolt 96 in the manner illustrated in FIG. 15.

Referring to FIGS. 1, 8, 11 and 16, a two key locking device 20 which requires the use of two keys to open (such as shown in FIGS. 17–20) has two lock cylinders 92 of the type illustrated in FIG. 11. Each of the two lock cylinders 92 are mounted in the housing 78 for internal locking device 20 by using a cylinder plug 98.

Figure 16:
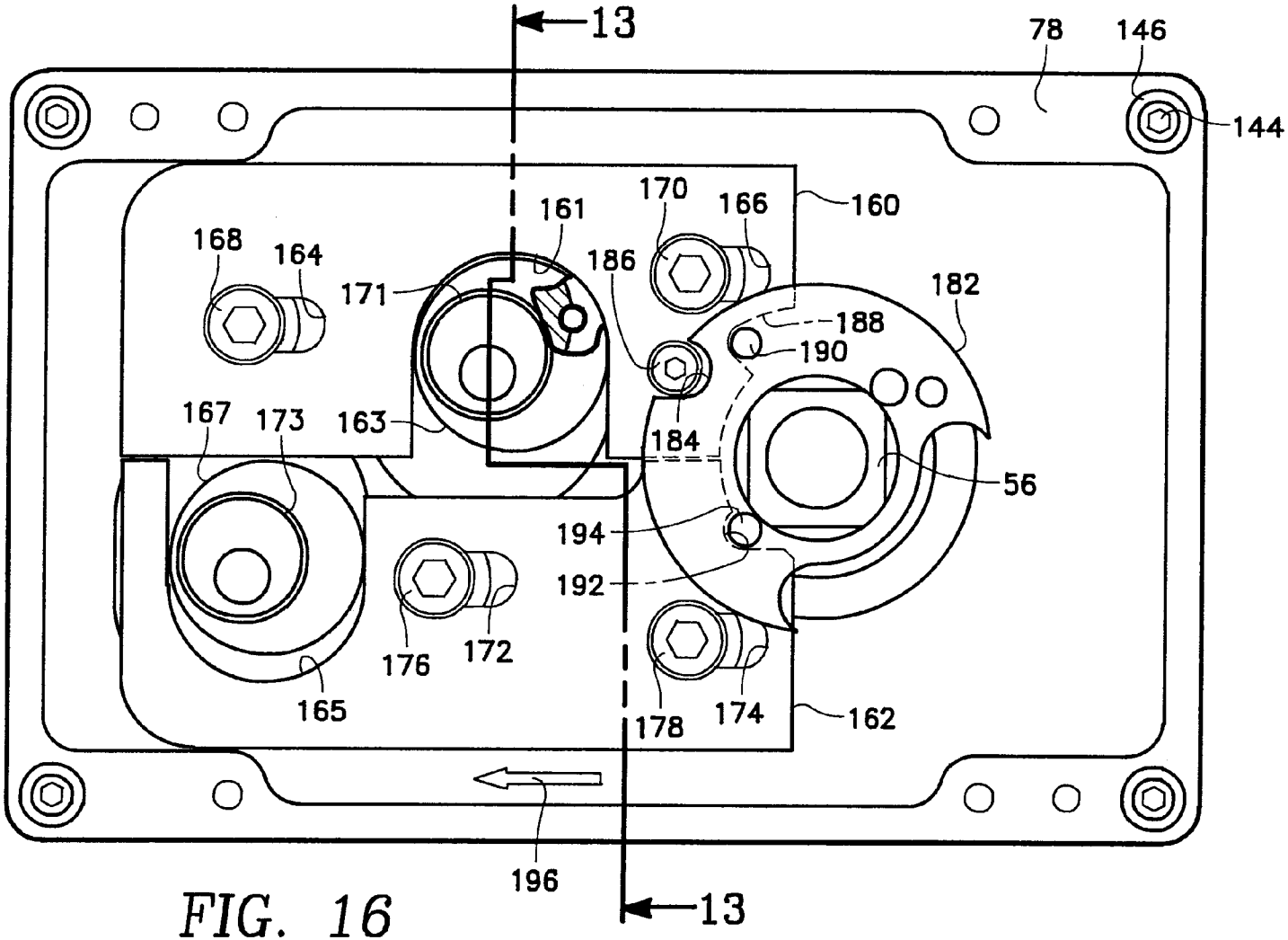
FIG. 16 illustrates a dual locking bolt arrangement which engages and prevents rotation of the output shaft until the operator dis-engages the locking bolts from the output shaft using a pair of keys.
Figure 17:
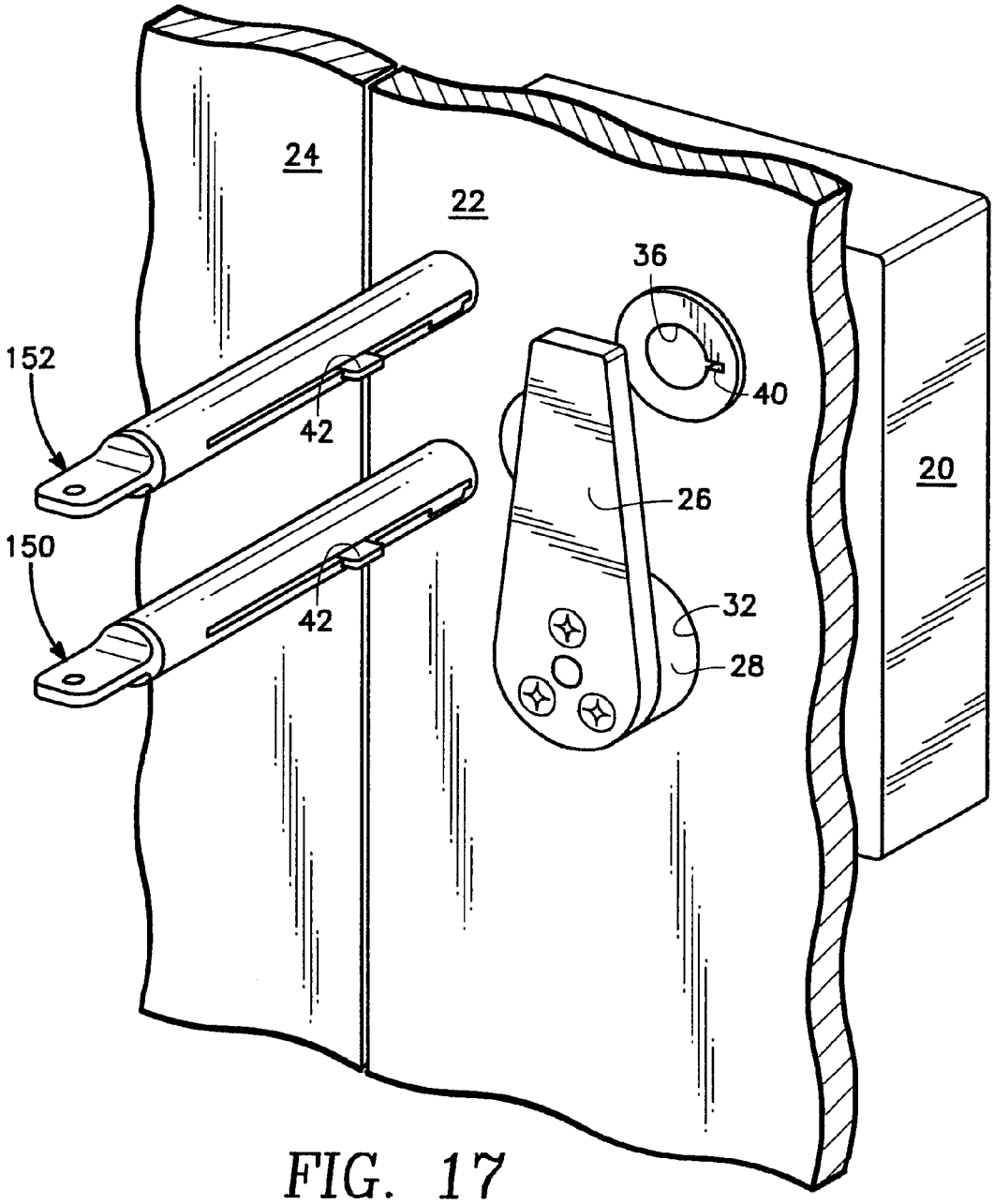
FIGS. 17–20 illustrate the operation of the internal locking device of the present invention when the operator uses a pair of keys to open the magazine doors for the weapons storage facility.
Figure 18:
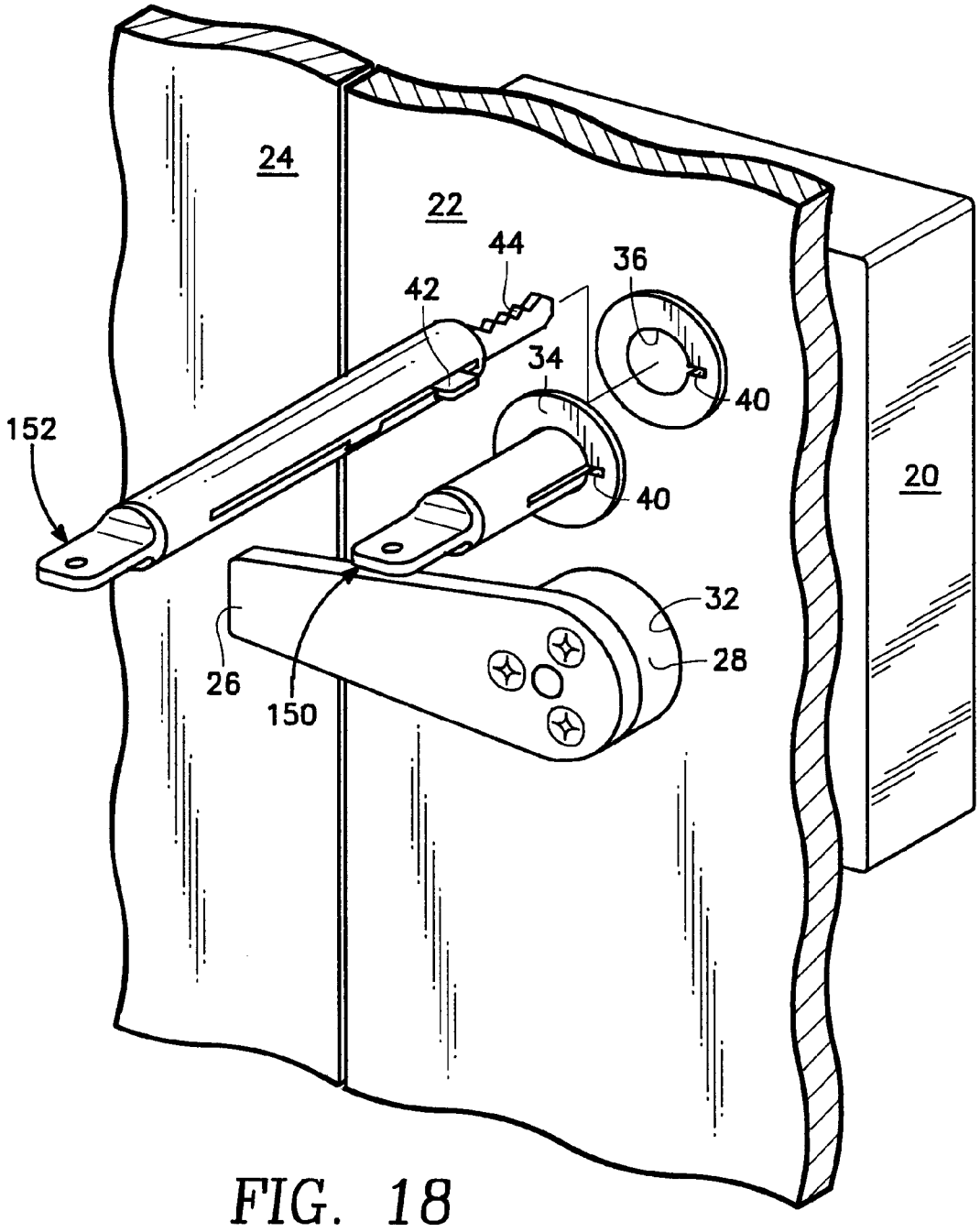

As is best depicted in FIG. 16, there are two locking bolts/locking plates 160 and 162 slidably mounted in housing 78. The locking bolt 160 has a U shaped slot 161 in which a lock cylinder cam 161 rotates when the operator turns one of the two keys. An eccentric cam shaft 171 is attached to the cylinder for one of the two lock cylinders 92 of device 20. The lock cylinder cam 161 is mounted on shaft 171 such that rotation of the shaft 171 rotates the cam 161.

The locking bolt 160 includes a pair of horizontally positioned slots 164 and 166. Affixed to a front portion of internal locking device housing 78 and removable therefrom are a pair of set screw 168 and 170. As depicted in FIG. 15 set screw 168 is positioned within slot 164 and in slidable engagement therewith and set screw 170 is positioned within slot 166 and in slidable engagement therewith.

Similarly, the locking bolt 162 has a U shaped slot 165 in which a lock cylinder cam 167 rotates when the operator turns the second of the two keys. An eccentric cam shaft 173 is attached to the cylinder for the other of the two lock cylinders 92 of device 20. The lock cylinder cam 167 is mounted on shaft 173 such that rotation of the shaft 173 rotates the cam 167.

The locking bolt 162 includes a pair of horizontally positioned slots 172 and 174. Affixed to a front portion of internal locking device housing 78 and removable therefrom are a pair of set screws 176 and 178. As depicted in FIG. 15 set screw 176 is positioned within slot 172 and in slidable engagement therewith and set screw 178 is positioned within slot 174 and in slidable engagement therewith.

Internal locking device 20 uses an aluminum body and lock bolt construction to reduce cost and provide predetermined failure points rather than to resist attacks. This allows the lock to break at identified points. For example, one failure point is depicted in FIG. 15. A mounting shoulder 146 which is fabricated from very thin circular shaped aluminum rim is used in combination with a mounting bolt to the secure the housing 78 for device 20 to a mounting plate on the magazine door 22. As depicted in FIG. 15, there are four mounting shoulders and their associated mounting bolts required to mount the internal locking device to the magazine door. In addition, to allowing the locking device to break loose, the mounting shoulders and mounting bolts provide a means for mounting device 20 in two directions.

As shown in FIG. 16, the internal locking device 20 includes a second failure point which consist of the use of aluminum lock bolts 160 and 162 and shoulder/set screws 168, 170, 176 and 178. When the weapons storage facility is attacked, the second failure point causes the lock bolts to fail to retract which makes it impossible for the output shaft 56 to rotate. Failure of the output shaft 56 to rotate results in attacker not being able to open the magazine doors 22 and 24 for the weapons storage facility.

It should be noted at this time that a Teflon anodized coating on an aluminum body, that is the internal locking device housing and its associated components and the locking bolts. The use of Teflon on the elements of internal locking device 20 makes device 20 maintenance free.

For the embodiment of device 20 which uses two keys to open the magazine doors 22 and 24, The output shaft 56 has a generally circular shaped plate 182 affixed thereto. Rotation of the output shaft 56 rotates plate 182. Plate 182 includes a semi-circular indent 184 formed on its outer edge which engages a set screw 186 bolted to locking plate 160.

Locking bolt 160 also has a semi-circular indent 188 formed on its outer edge which engages a locking pin 190 affixed to internal locking device housing 78. Similarly, locking bolt 162 has a semi-circular indent 192 formed on its outer edge which engages a locking pin 194 affixed to internal locking device housing 78.

Set screw 186 and locking pins 190 and 194 prevent rotational movement of output shaft 56 until an operator disengages set screw 186 from indent 184, locking pin 190 from indent 188 and locking pin 194 from indent 192 by rotating the keys counter-clockwise which moves locking bolts 160 and 162 in the direction indicated by arrow 196.

Referring now to FIG. 8, handle extension 28 is affixed to one end of cam shaft 88 by set screw 89 and a keeper ring 91 positioned around the periphery of handle 28. The opposite end of cam shaft 88 is attached to the clutch sleeve 103 for a clutch 104. Attached to a forward portion of clutch 104 and extending therefrom in a forward direction (toward to the output shaft 56) is an shaft engagement pin 105. The clutch 104 is a spring loaded clutch utilizing a spring 106 centrally located within a rear portion housing 78 between the clutch 104 and the output shaft 56. The spring 106 maintains the clutch 104 in a fixed positioned relative to the output shaft 56 separating the clutch 104 from output shaft 56 until the operator desires to unlock the magazine doors 22 and 24.

When the operator desires to unlock the magazine doors 22 and 24, the operator pushes the handle 26 and handle extension 28 forward such that the output shaft engagement pin 108 will pass through an opening 108 and engage a spring loaded detent 110. When pin 108 engages the detent 110, the operator can turn handle 26 ninety degrees in a counterclockwise direction. The detent 110 insures that the handle 26, clutch 104, clutch sleeve 103 and output shaft 56 are synchronized when the handle 26 is turned. The detent 110 also prevents the shaft 56 from being turned prior to depressing the handle 26.

At this time it should be noted that internal locking device 20 is a true dual locking system since the shutter plate 74 is not controlled or locked in position by a key. The shutter plate 74 is used to activate the alarm system illustrated in FIG. 10 and as a dust cover to prevent damage to the internal components of the internal locking device 20.

Referring to FIGS. 17–20, the unlocking procedure for the magazine doors 22 and 24 when there is a requirement to use two keys 150 and 152 to unlock the magazine doors 22 and 24 is depicted in FIGS. 17–20. The operator first pushes the keys 150 and 152 forwarded and latches the keys 150 and 152 into an extended position as shown in FIG. 6A. The operator next rotates the handle 26 ninety degrees counter-clockwise to allow access to the internal locking device 20 two lock cylinders. The keys 150 and 152 are inserted into cylindrical shaped openings 34 and 36 within magazine door 22 which are adapted to receive the high security keys 150 and 152. The guide slots 40 for each opening 34 and 36 insures that each key 150 and 152 is in the correct positioned for insertion into the lock cylinders for internal locking device 20.

Figure 19:
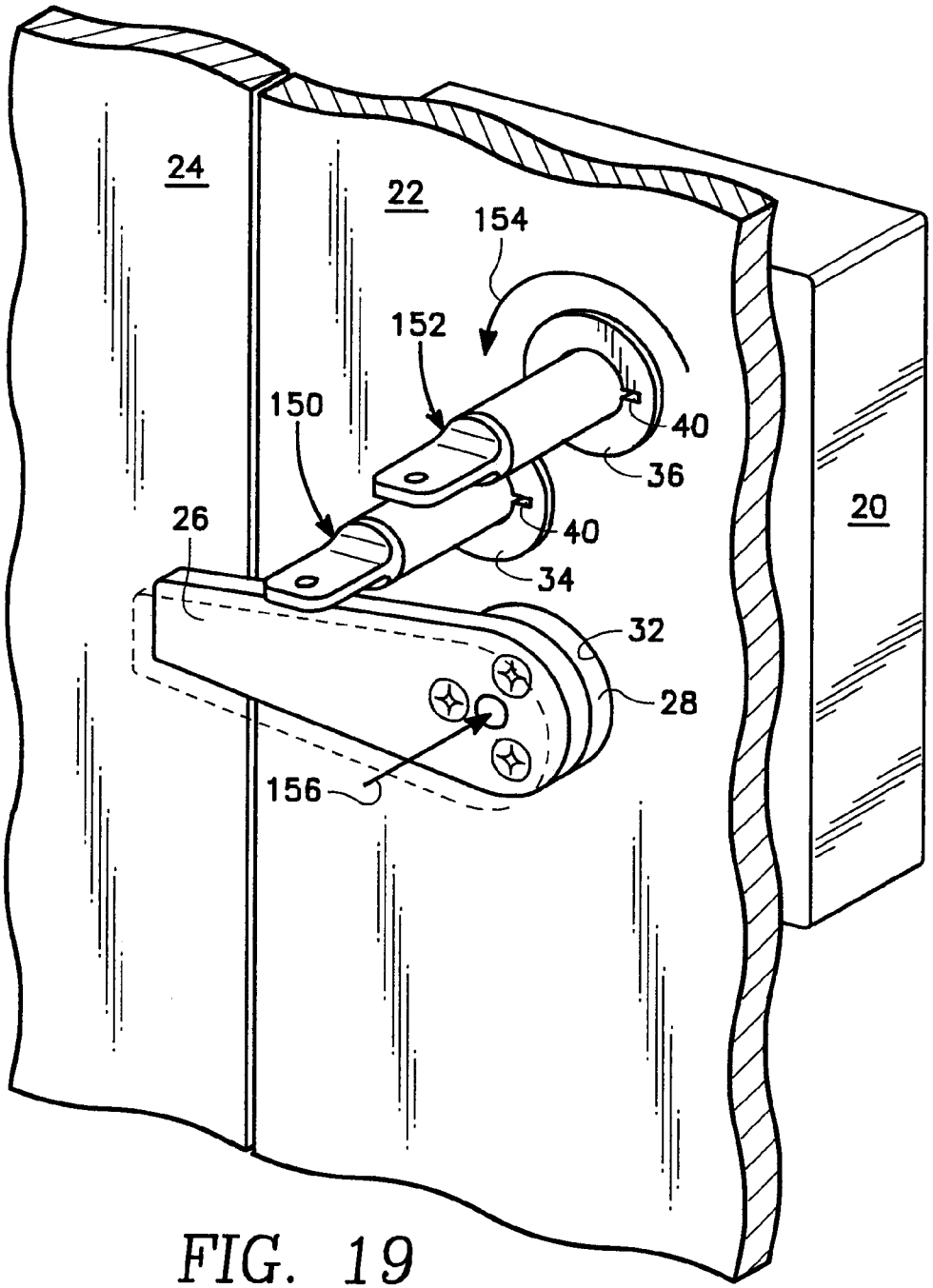
Figure 20:
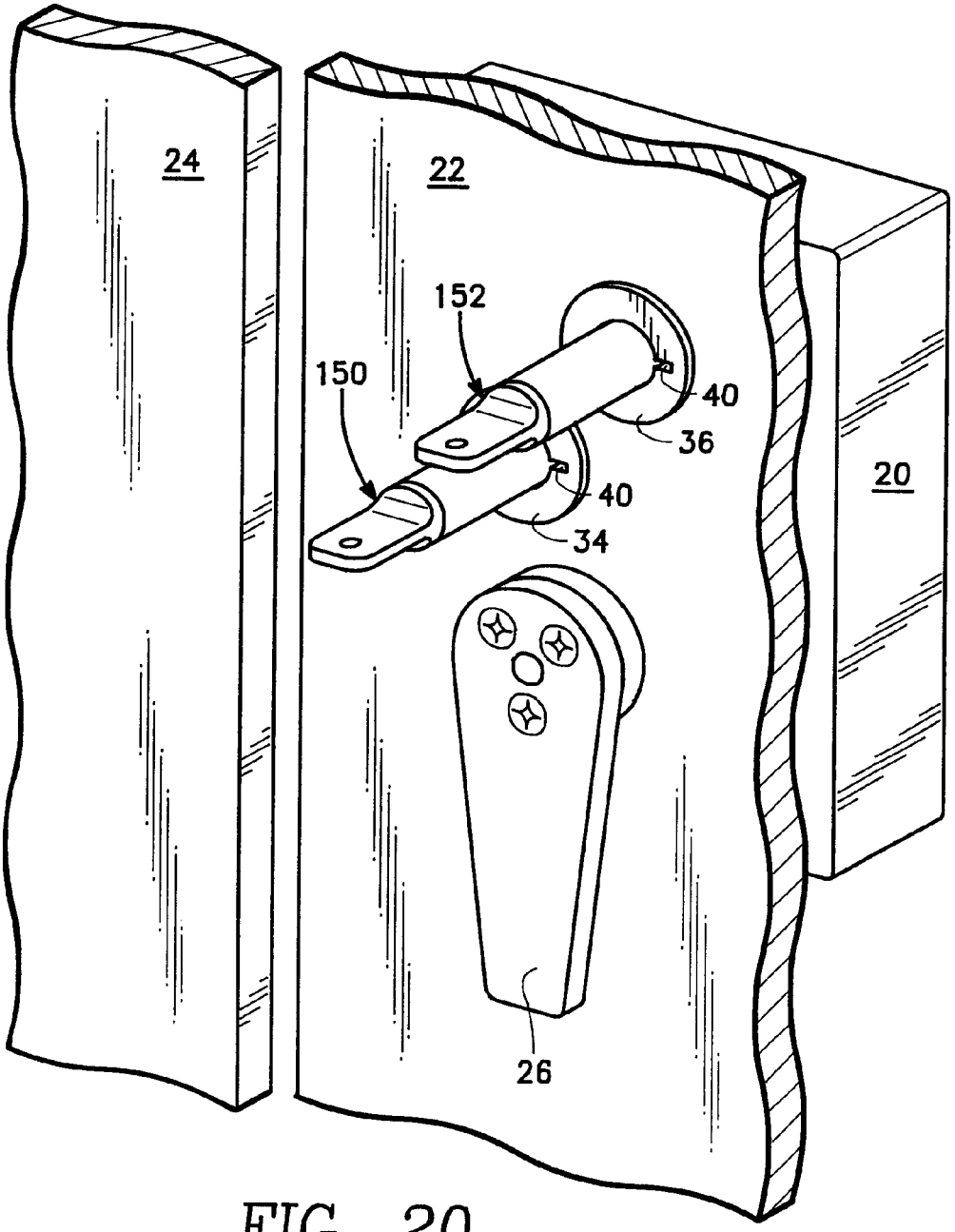

The operator next rotates the keys 150 and 152 counter-clockwise 180 degrees as is best indicated by arrow 154 (FIG. 19). The operator pushes the handle 26 inward until the handle 26 stops (as indicated by arrow 156) and rotates the handle 26 ninety degrees counter-clockwise (as indicated by arrow 158). The magazine doors 22 and 24 are now unlocked and may be opened by the operator.

The dual key locking procedure for the internal locking device 20 requires the operator to first rotate handle 26 ninety degrees clockwise, rotate the keys 150 and 152 one hundred eighty degrees clockwise and then remove the keys 150 and 152 from the magazine door 22. The handle 26 is rotating an additional ninety degrees and the keys are retracted into the key housings as depicted in FIG. 6B.

For a single lock, the unlocking and locking procedures are almost identical. To unlock device 20, the operator rotates the operating handle 90 degrees counter clockwise to allow access to the lock cylinder, inserts key into the lock cylinder and rotates the key 180 degrees. The operator the handle inward until the handle stops and rotates the handle ninety degrees counter-clockwise which allows the operator to open the magazine doors and access the weapons storage facility. To lock device 20, the operator rotates the handle ninety degrees clockwise, rotates the key 180 degrees counterclockwise, removes the key and then rotates the handle an additional ninety degrees clockwise.

From the foregoing it may readily be seen that the present invention comprises a new, unique and exceedingly useful internal locking device for use with the magazine doors of a weapons storage facility which constitutes a considerable improvement over the known prior art. Obviously, many modifications of the present invention are possible in light of the above teachings. It is therefore to be understood that within the scope of the appended claims that the invention may be practiced otherwise than as specifically described.

What is claimed is:

1. A method for opening magazines doors on a weapons storage facility, comprising the steps of:

(a) rotating a handle for a security lock, mounted on one of said magazine doors, counterclockwise approximately ninety degrees, said handle being coupled to a shutter plate to rotate said shutter plate when said handle is rotated, said shutter plate when rotated exposing a first lock cylinder and a second lock cylinder mounted within said security lock;

(b) inserting a first key into said first lock cylinder;

(c) rotating said first key counterclockwise approximately one hundred eighty degrees after said first key is inserted into said first lock cylinder, said first lock cylinder being connected to a first eccentric cam wherein said first eccentric cam rotates when said first key rotates, said first eccentric cam engaging a first locking plate such that said first locking plate moves laterally when said eccentric cam rotates;

(d) inserting a second key into said second lock cylinder;

(e) rotating said second key counterclockwise approximately one hundred eighty degrees after said second key is inserted in said second lock cylinder, said second lock cylinder being connected to a second eccentric cam wherein said second eccentric cam rotates when said second key rotates, said second eccentric cam engaging a second locking plate such that said second locking plate moves laterally when said eccentric cam rotates, said first locking plate and said second locking plate holding an output shaft for said security lock in a fixed rotational position until said first key and said second key are rotated in a counterclockwise direction to move said first locking plate and said second locking plate away from said output shaft;

(d) pushing said handle inward to a position where a clutch connected to said handle engages the output shaft for said security lock, said handle being released from said shutter plate when said handle is pushed inward; and (e) rotating said handle counterclockwise approximately ninety degrees which rotates the output shaft for said security lock allowing a user to open the magazine doors for said weapons storage facility.

2. The method of claim 1 further comprising the step of withdrawing a door locking bolt from a locking bolt receiver mounted on the other of said magazine doors, said door locking bolt being connected to said output shaft wherein a rotation of said output shaft in a clockwise direction approximately ninety degrees causes said door locking bolt to be withdraw from said locking bolt receiver allowing said user to open the magazine doors for said weapons storage facility.

3. The method of claim 2 wherein said cam arm is connected to an end of said output shaft which extends from said security lock, said door locking arm having a substantially vertically positioned slot disposed at one end of said door locking bolt, said cam arm having a locking screw, said locking screw being slidably positioned within the slot for said door locking bolt.

4. The method of claim 1 further comprising the step of deactivating a security alarm connected to the shutter plate for said security lock prior to unlocking said magazine doors.

5. The method of claim 1 wherein said security alarm is deactivated by opening a normally closed switch, said normally closed switch being connected to said security alarm and a normally open alarm activation switch, said normally open alarm activation switch engaging said shutter plate when said shutter plate is rotated to expose said lock cylinder.

6. The method of claim 1 further comprising the step of removing a broken key from said first and second lock cylinders whenever said first and second keys break within said first and second lock cylinders by using a duplicated key inserted into said first and second lock cylinders, said duplicate key forcing said broken key from said first and second lock cylinders through a back plate within said security lock.

7. The method of claim 1 wherein each of said first and second key includes a cylindrical housing which allows said user to retract said first or second key into said cylindrical housing to prevent damage to said first and second keys whenever said first and second keys are not in use.

8. The method of claim 1 wherein said shutter plate prevents dust and contamination from entering said first and second lock cylinders preventing damage to said first and second lock cylinders.

9. A lock apparatus for securing a pair of magazine doors on a weapons storage facility, a handle having a handle extension rotabably mounted within a door handle opening in a first magazine door of said pair of magazine doors;

a rotatable shutter plate positioned on the inside of said first magazine door, said handle extension rotatably engaging said shutter plate when said handle is fully extended from said first magazine door;

first and second retractable keys, each of said first and second retractable keys having a cylindrical shaped housing and a key guide, said first retractable key being adapted to fit within a first cylindrical shaped opening having a slot within said first magazine door and said second retractable key being adapted to fit within a second cylindrical shaped opening having a slot within said first magazine door;

a lock housing mounted on the inside of said first magazine door in alignment with said first cylindrical shaped opening, said second cylindrical shaped opening and said door handle opening, said housing having a back plate;

a first lock cylinder mounted within said lock housing, said first lock cylinder being aligned with said first cylindrical shaped opening to receive said first retractable key when said handle is rotated approximately ninety degrees counterclockwise which rotates said shutter plate permitting key access to said first lock cylinder;

a second lock cylinder mounted within said lock housing, said second lock cylinder being aligned with said second cylindrical shaped opening to receive said second retractable key when said handle is rotated approximately ninety degrees counterclockwise which rotates said shutter plate permitting key access to said second lock cylinder;

a first eccentric cam rotatably mounted within said lock housing, said first eccentric cam being connected to said first lock cylinder wherein said first eccentric cam rotates when rotates said first retractable key rotates within said first lock cylinder;

a second eccentric cam rotatably mounted within said lock housing, said second eccentric cam being connected to said second lock cylinder wherein said second eccentric cam rotates when rotates said second retractable key rotates within said second lock cylinder;

a first locking plate slidable mounted in said lock housing, said first eccentric cam engaging said first locking plate such that said first locking plate moves laterally within said housing when said first eccentric cam rotates;

a second locking plate slidable mounted in said lock housing, said second eccentric cam engaging said second locking plate such that said second locking plate moves laterally within said housing when said second eccentric cam rotates;

an output shaft rotatably mounted in said lock housing, said output shaft extending from said lock housing through a shaft opening within the back plate of said lock housing, said first locking plate and said second locking plate holding said output shaft in a fixed rotational position; and a spring loaded clutch affixed to said handle extension, said spring loaded clutch having an engagement pin, said spring loaded clutch being aligned with said output shaft to move in a forward direction within said housing and engage said output shaft to permit rotational movement of said output shaft after said first eccentric cam and said eccentric cam each rotate in a first direction which moves said first locking plate and said second locking plate laterally away from said output shaft releasing said output shaft from said fixed rotational position.

10. The lock apparatus of claim 9 further comprising a spring loaded detent positioned within said output shaft in alignment with the engagement pin for said spring loaded clutch, said spring loaded detent when engaged by the engagement pin for said spring loaded clutch insuring synchronous rotational movement between said output shaft and said clutch.

11. The lock apparatus of claim 9 wherein a user inserts said first retractable key into said first lock cylinder and rotates said first retractable key approximately one hundred degrees counterclockwise and said user inserts said second retractable key into said second lock cylinder and rotates said second retractable key approximately one hundred degrees counterclockwise which releases said output shaft from said first locking plate and said second locking plate allowing said user to depress the handle of said locking apparatus engaging said output shaft and dis-engaging said shutter plate and then rotate said handle ninety degree counterclockwise to open said pair of magazine doors.

12. The lock apparatus of claim 9 wherein the slot of said first cylindrical shaped opening is adapted to receive said key guide for said first retractable key aligning said first retractable key with said first lock cylinder which prevents damage to said first retractable key when said user inserts said first retractable key into said first lock cylinder and the slot of said second cylindrical shaped opening is adapted to receive said key guide for said second retractable key aligning said second retractable key with said second lock cylinder which prevents damage to said second retractable key when said user inserts said second retractable key into said second lock cylinder.

13. The lock apparatus of claim 9 further comprising a door locking bolt which extends into a locking bolt receiver mounted on a second magazine door of said pair of magazine doors, said door locking bolt being retractable from said locking bolt receiver, said door locking bolt being connected to said output shaft wherein a rotation of said output shaft in a clockwise direction approximately ninety degrees causes said door locking bolt to be withdraw from said locking bolt receiver allowing a user to open the magazine doors for said weapons storage facility.

14. The lock apparatus of claim 13 further comprising a cam arm is connected to an end of said output shaft which extends from said security lock, said door locking bolt having a substantially vertically positioned slot disposed at one end of said door locking bolt, said cam arm having a locking screw, the locking screw of said cam arm being slidably positioned within the slot for said door locking bolt.

15. The lock apparatus of claim 9 further comprising a security alarm connected to the shutter plate for said security wherein a user de-activates said security alarm prior to unlocking said magazine doors.

16. The lock apparatus of claim 15 wherein said security alarm is deactivated by opening a normally closed switch, said normally closed switch being connected to said security alarm and a normally open alarm activation switch, said normally open alarm activation switch engaging said shutter plate when said shutter plate is rotated to expose said lock cylinder.

17. The lock apparatus of claim 9 wherein said shutter plate prevents dust and contamination from entering said lock cylinder preventing damage to said lock cylinder.

18. A lock apparatus for securing a pair of magazine doors on a weapons storage facility, comprising:

a handle having a handle extension rotabably mounted within a door handle opening in a first magazine door of said pair of magazine doors;

a rotatable shutter plate positioned on the inside of said first magazine door, said handle extension rotatably engaging said shutter plate when said handle is fully extended from said first magazine door;

a retractable key having a cylindrical shaped housing and a key guide, said retractable key being adapted to fit within a cylindrical shaped opening having a slot within said first magazine door;

a lock housing mounted on the inside of said first magazine door in alignment with said cylindrical shaped opening and said door handle opening, said housing having a back plate;

a first lock cylinder mounted within said lock housing, said first lock cylinder being aligned with said first cylindrical shaped opening to receive said first retractable key when said handle is rotated approximately ninety degrees counterclockwise which rotates said shutter plate permitting key access to said first lock cylinder;

a second lock cylinder mounted within said lock housing, said second lock cylinder being aligned with said second cylindrical shaped opening to receive said second retractable key when said handle is rotated approximately ninety degrees counterclockwise which rotates said shutter plate permitting key access to said second lock cylinder;

a first eccentric cam rotatably mounted within said lock housing, said first eccentric cam being connected to said first lock cylinder wherein said first eccentric cam rotates when rotates said first retractable key rotates within said first lock cylinder;

a second eccentric cam rotatably mounted within said lock housing, said second eccentric cam being connected to said second lock cylinder wherein said second eccentric cam rotates when rotates said second retractable key rotates within said second lock cylinder;

a first locking plate slidable mounted in said lock housing, said first eccentric cam engaging said first locking plate such that said first locking plate moves laterally within said housing when said first eccentric cam rotates;

a second locking plate slidable mounted in said lock housing, said second eccentric cam engaging said second locking plate such that said second locking plate moves laterally within said housing when said second eccentric cam rotates;

an output shaft rotatably mounted in said lock housing, said output shaft extending from said lock housing through a shaft opening within the back plate of said lock housing, said first locking plate and said second locking plate holding said output shaft in a fixed rotational position; and a spring loaded clutch affixed to said handle extension, said spring loaded clutch having an engagement pin, said spring loaded clutch being aligned with said output shaft to move in a forward direction within said housing and engage said output shaft to permit rotational movement of said output shaft after said first eccentric cam and said eccentric cam each rotate in a first direction which moves first locking plate and said second locking plate laterally away from said output shaft releasing said output shaft from said fixed rotational position a door locking bolt which extends into a locking bolt receiver mounted on a second magazine door of said pair of magazine doors, said door locking bolt being retractable from said locking bolt receiver, said door locking bolt being connected to said output shaft wherein a rotation of said output shaft in a clockwise direction approximately ninety degrees causes said door locking bolt to be withdraw from said locking bolt receiver to permit an opening of the magazine doors for said weapons storage facility;

a cam arm connected to the end of said output shaft which extends from said security lock, said door locking bolt having a substantially vertically positioned slot disposed at one end of said door locking bolt, said cam arm having a locking screw, the locking screw of said cam arm being slidably positioned within the slot for said door locking bolt; and a security alarm connected to the shutter plate for said security wherein said security alarm is de-activate prior to unlocking said magazine doors.

19. The lock apparatus of claim 18 further comprising a spring loaded detent positioned within said output shaft in alignment with the engagement pin for said spring loaded clutch, said spring loaded detent when engaged by the engagement pin for said spring loaded clutch insuring synchronous rotational movement between said output shaft and said clutch.

20. The lock apparatus of claim 18 wherein a user inserts said first retractable key into said first lock cylinder and rotates said first retractable key approximately one hundred degrees counterclockwise and said user inserts said second retractable key into said second lock cylinder and rotates said second retractable key approximately one hundred degrees counterclockwise which releases said output shaft from said first locking plate and said second locking plate allowing said user to depress the handle of said locking apparatus engaging said output shaft and dis-engaging said shutter plate and then rotate said handle ninety degree counterclockwise to open said pair of magazine doors.

21. The lock apparatus of claim 18 wherein the slot of said first cylindrical shaped opening is adapted to receive said key guide for said first retractable key aligning said first retractable key with said first lock cylinder which prevents damage to said first retractable key when said user inserts said first retractable key into said first lock cylinder and the slot of said second cylindrical shaped opening is adapted to receive said key guide for said second retractable key aligning said second retractable key with said second lock cylinder which prevents damage to said second retractable key when said user inserts said second retractable key into said second lock cylinder.

22. The lock apparatus of claim 18 wherein said security alarm is deactivated by opening a normally closed switch, said normally closed switch being connected to said security alarm and a normally open alarm activation switch, said normally open alarm activation switch engaging said shutter plate when said shutter plate is rotated to expose said lock cylinder.

23. The lock apparatus of claim 18 wherein said shutter plate prevents dust and contamination from entering said lock cylinder preventing damage to said lock cylinder.

* * * * *